US006094193A

United States Patent [19]

Katsura et al.

[11] Patent Number: 6,094,193

[45] **Date of Patent: *Jul. 25, 2000**

[54] DISPLAY CONTROLLER

[75] Inventors: Koyo Katsura; Hideo Maejima, both of Hitachi; Hiroshi Takeda, Chiba, all of Japan

[73] Assignee: Hitachi, Ltd., Tokyo, Japan

[ * ] Notice: This patent is subject to a terminal disclaimer.

[21] Appl. No.: 08/989,390

[22] Filed: Dec. 12, 1997

Related U.S. Application Data

[60] Continuation of application No. 08/627,546, Apr. 4, 1996, abandoned, which is a division of application No. 07/799,889, Dec. 2, 1991, Pat. No. 5,696,540, which is a continuation of application No. 07/198,067, May 24, 1988, abandoned, which is a continuation of application No. 06/626,992, Jul. 2, 1984, Pat. No. 4,757,310.

[30] Foreign Application Priority Data

Jan. 7, 1983 [JP] Japan ..... 58-118228

[51] Int. Cl.[7] ..... G09G 5/00; G09G 5/04

[52] U.S. Cl. ..... 345/213; 345/186

[58] Field of Search ..... 345/28, 200, 201, 345/213, 27, 185, 186, 115, 116

[56] References Cited

U.S. PATENT DOCUMENTS

| | | | |
|---|---|---|---|
| 4,104,624 | 8/1978 | Hamada | 345/28 |
| 4,200,869 | 4/1980 | Murayama et al. | 345/201 |
| 4,412,294 | 10/1983 | Watts et al. | 345/123 |
| 4,485,378 | 11/1984 | Matsui et al. | 345/28 |
| 4,533,910 | 8/1985 | Sukonick et al. | 345/118 |
| 4,574,364 | 3/1986 | Tabata et al. | 345/119 |
| 4,757,310 | 7/1988 | Katsura et al. | 345/28 |
| 4,785,296 | 11/1988 | Tabata et al. | 345/129 |

*Primary Examiner*—Steven J. Saras
*Assistant Examiner*—Paul Bell
*Attorney, Agent, or Firm*—Antonelli, Terry, Stout & Kraus, LLP

[57] ABSTRACT

In an image displaying field where there is a tendency which will increase the data to be handled in accordance with the high integration of a display device, a CRT controller according to the present invention improves the superposed display and the responsiveness of the display and drawing operations by dividing a unit clock into a predetermined number to function with high speed and a multifunctional display. When image data are to be inputted or outputted from a refresh memory corresponding to a display frame, the memory content and the display address are assigned at a ratio of 1:n to effect the processings in parallel. As a result, the time period utilized by the display cycle of the prior art can be assigned to the drawing operation so that the processing can be speeded up while making it easier than the prior art to effect the superposed display of letters, symbols and drawings. The resultant effect is that it is unnecessary to increase the number of refresh memories corresponding to the displayed frame and that the external parts can be simplified to contribute to the improvement in the reliability.

2 Claims, 24 Drawing Sheets

UNSPECIFIED
( YELLOW → RED → BLUE )

SPECIFIED
BLACK

INHIBITED
RED

PRIORITY DRAWING
[RED > YELLOW
> BLUE
> BLACK]

PHYSICAL SPACE
BIT 15
BIT 0
PIXEL DATA
LSW
SA

LOGICAL SPACE
ORG
(x,y)
X
Y
x
y
LSW

DISPLAY SCREEN
SA
LSW : LOGICAL SCREEN WIDTH
ORG : ORIGIN POINT
SA : START ADDRESS

DISPLAY CONTROLLER

This is a Continuation of application Ser. No. 08/627,546, filed Apr. 4, 1996, now abandoned; which is a Divisional of application Ser. No. 07/799,889, filed Dec. 2, 1991, now U.S. Pat. No. 5,696,540; which is a continuation of Ser. No. 07/198,067, filed May 24, 1988, now abandoned; which is a continuation of Ser. No. 06/626,992, filed Jul. 2, 1984, now U.S. Pat. No. 4,757,310.

BACKGROUND OF THE INVENTION

The present invention relates to an LSI for controlling the display of picture data such as letters or drawings and, more particularly, to a display system controller which is suitable for superposed display of a plurality of frames.

DESCRIPTION OF THE PRIOR ART

In accordance with a highly integrated memory LSI, the cost of a graphic display equipped with a high-capacity memory is dropped so that letter displays are processed by a full bit map. In accordance with the high detail of a display device, there is an increase in the quantity of information to be handled. In these displays, the display control of letters and drawings is handled by a special purpose LSI (or a CRT controller).

Specifically, the CRT controller functions to sequentially output memory addresses from the display starting address which is preset in conformity with the raster scan. The CRT controller has another function to output a synchronizing signal for driving the display system. A CRT controller of the prior art type for displaying data from a plurality of independent frames, is shown in FIGS. 1 and 2.

Prior Art Example 1

FIG. 1 shows the method for controlling refresh memories having a plurality of divided banks by means of a single CRT controller 13. This CRT controller 13 is connected via an address bus 11 and a data bus 12 with a central processing unit (i.e., CPU) for generating refresh addresses for the display and a synchronizing signal for the CRT. A clock generator 14 feeds an operation clock to the CRT controller 13 and parallel-series converters 171 and 172. An address selector 15 selects the display memory address, which is fed from the CRT controller 13, during the display and the address bus 11 of the CPU during the non-display interval thereby to access the two refresh memory banks 161 and 162. The data read out from the memories are converted independently of each other by the parallel-series converters 171 and 172 into series signals, which are superposed in a synthesizing circuit 18.

Since the two memory banks are fed with the identical display address, according to the prior art system having the construction thus far described, the two frames to be superposed have to be of the same frame construction. Even in the case when the superposition is conducted only in one portion of the display frame, a memory capacity for two display frames is required which causes a problem that the memory efficiency is lessened. In the case when the frame is shifted by rewriting the display starting address, on the other hand, the two frames cannot be shifted independently of each other. Since, the contents of the refresh memories cannot be rewritten during the display, there is a defect that the drawing speed is slowed down.

Prior Art Example 2

FIG. 2 shows a method in which a plurality of CRT controllers shown in FIG. 1 are used to individually control a plurality of memory banks. Two CRT controllers 131 and 132 conduct their synchronizing operations in response to an identical clock from the clock generator 14 and individually generate display memory addresses to access the refresh memories 161 and 162. The data thus read out are converted by the parallel-series converters 171 and 172 into series signals so that a superposed image signal is generated in the synchronizing circuit 18.

Since the addresses of the two display frames are controlled independently of each other, the frames can be shifted independently of each other, but there arises a problem that the numbers of parts and wirings required are so large that the scale of the system is accordingly enlarged. In case the superposition is conducted only in a portion of the display frame, on the other hand, the capacities of the refresh memories can be reduced. Because of the construction in which the memories for the individual frames are physically separated, however, the design has to be made in conformity with the maximum size of the superposed frame. Moreover, the drawing speed is slow because the contents of the refresh memories cannot be rewritten during the display as in the case of FIG. 1. The prior art method belonging to that of FIG. 2, is disclosed in the specification of Japanese Patent Laid-Open No. 52-95926.

SUMMARY OF THE INVENTION

An object of the present invention is to provide a display controller which can conduct the superposed display of a plurality of display frames with a simple construction.

According to a feature of the present invention, display addresses of n (i.e., an integer equal to or larger than 2) independent systems are generated during one display period so that data stored in the corresponding addresses are sequentially read out from a refresh memory in accordance with those display addresses and used for the superposed display.

In order to ensure the above feature, the display controller of the present invention is constructed to include:

(1) a timing processor receptive of a clock to generate a display address generating a timing signal having a timing prepared by dividing one display period by n; and (2) a display processor stored with n groups of display starting addresses for sequentially generating display addresses corresponding to the respective groups, each time it receives the timing, with reference to the display starting addresses to output the display addresses to a refresh memory.

Table 1 tabulates the representative specifications of the display controller of the present invention. The present controller has a graphics drawing function to make a variety of drawings on a frame memory. More specifically, thirty eight kinds of drawing commands such as commands for drawing a straight line, circle and ellipse, painting out or copying.

An X–Y coordinate system is used for addressing a drawing point so that the load upon the development of an application software can be remarkably lightened. The frame memory has a high capacity of 2 megabytes at the maximum and can support a frame size of 2,048×2,048 dots for a 16-color display. The display controller has various display control functions such as frame dividing, smooth scrolling, magnifying or superposing functions.

TABLE 1

Specification of Display Controller

| Items | Specifications |
|---|---|
| Operating Frequencies | 1 MHz–8 MHz<br>1 MHz–6 MHz<br>1 MHz–4 MHz |
| Display Memory Capacities | For graphic: 2 Mbytes<br>For characters: 128 Kbytes |
| Drawing Commands | 38 kinds<br>Straight lines, squares, polygons, circles, ellipses, painting-out and copying |
| Drawing Functions | Address administration on X-Y coordinates<br>Drawing function by patterns<br>Masking function by color conditions<br>Drawing region administering function<br>DMA transferring function |
| Drawing Speed | Common for monochromatic and color<br>Linear drawing speed: 500 ns/dot (for 8 MHz) |
| Displaying Functions | Frame division: 3 horizontal + 1 window<br>Hor. and Vert. Smooth scrolling<br>Magnified display (1 to 16 times in Hor. and Vert. directions)<br>Superposition of frames<br>External Synchronism<br>Graphic cursor function |

BRIEF DESCRIPTION OF DRAWINGS

FIG. 10-2 shows the mode of the superposed display;

FIG. 10-3 shows another example of the structure of the display frame;

FIG. 10-4 shows an example of the frame division;

FIG. 19-2 explains the detail of the same;

FIG. 20-2 shows the relationship between the address space of the frame memory and the display;

DESCRIPTION OF THE PREFERRED EMBODIMENT INCLUDING THE BEST MODE FOR CARRYING OUT THE INVENTION

Figure 4:
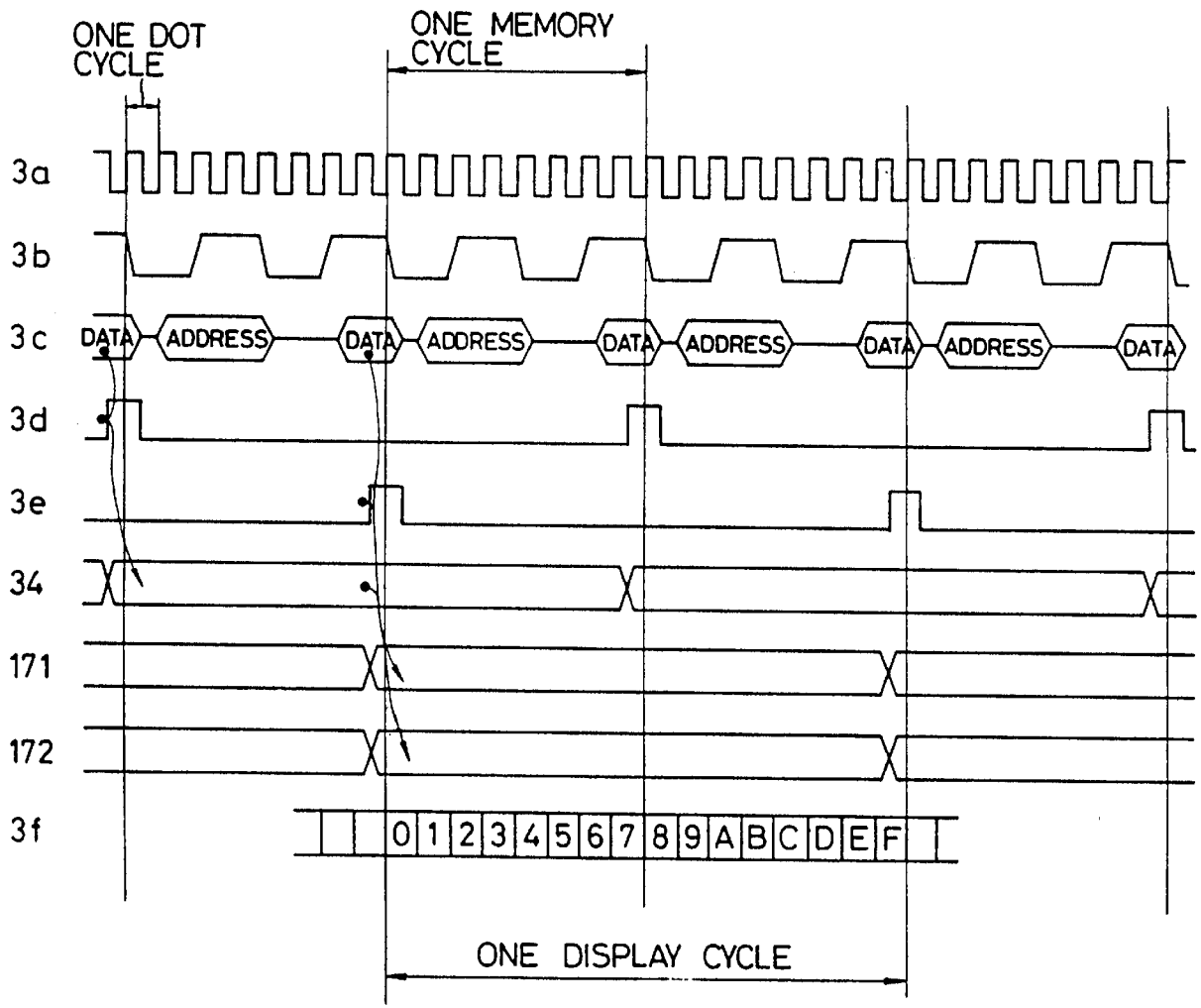
FIG. 4 shows the time chart of the operations.
Figure 5:
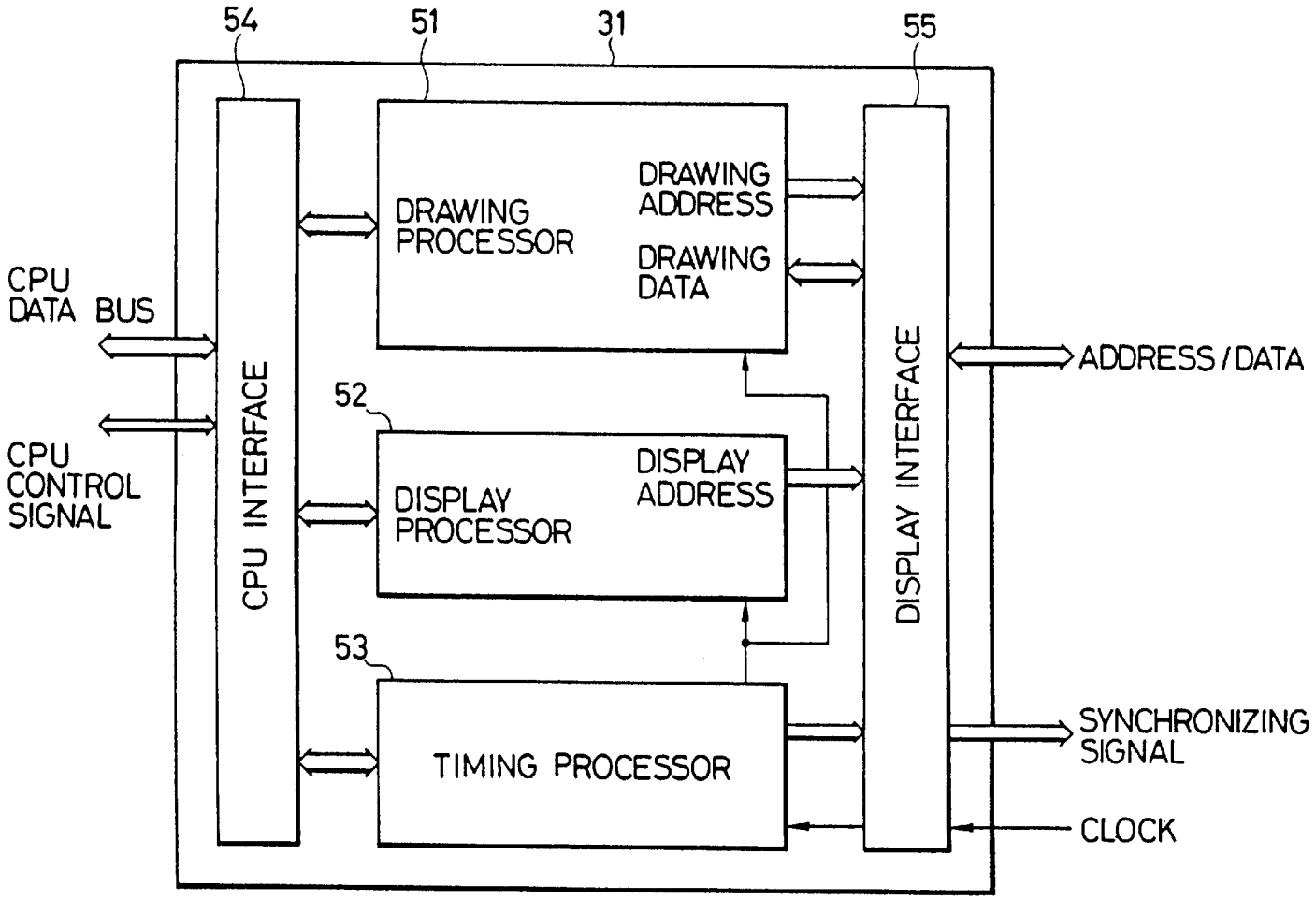
FIG. 5 shows the internal construction of the display controller of the present invention.

FIG. 5 shows the internal construction of the display controller 31 according to the present invention. Moreover, an example, in which the display system is constructed by using the controller, is shown in FIG. 3, and a time chart of the superposed display for explaining the effect featuring the present invention is shown in FIG. 4.

1. Example for System Construction

Figure 1:
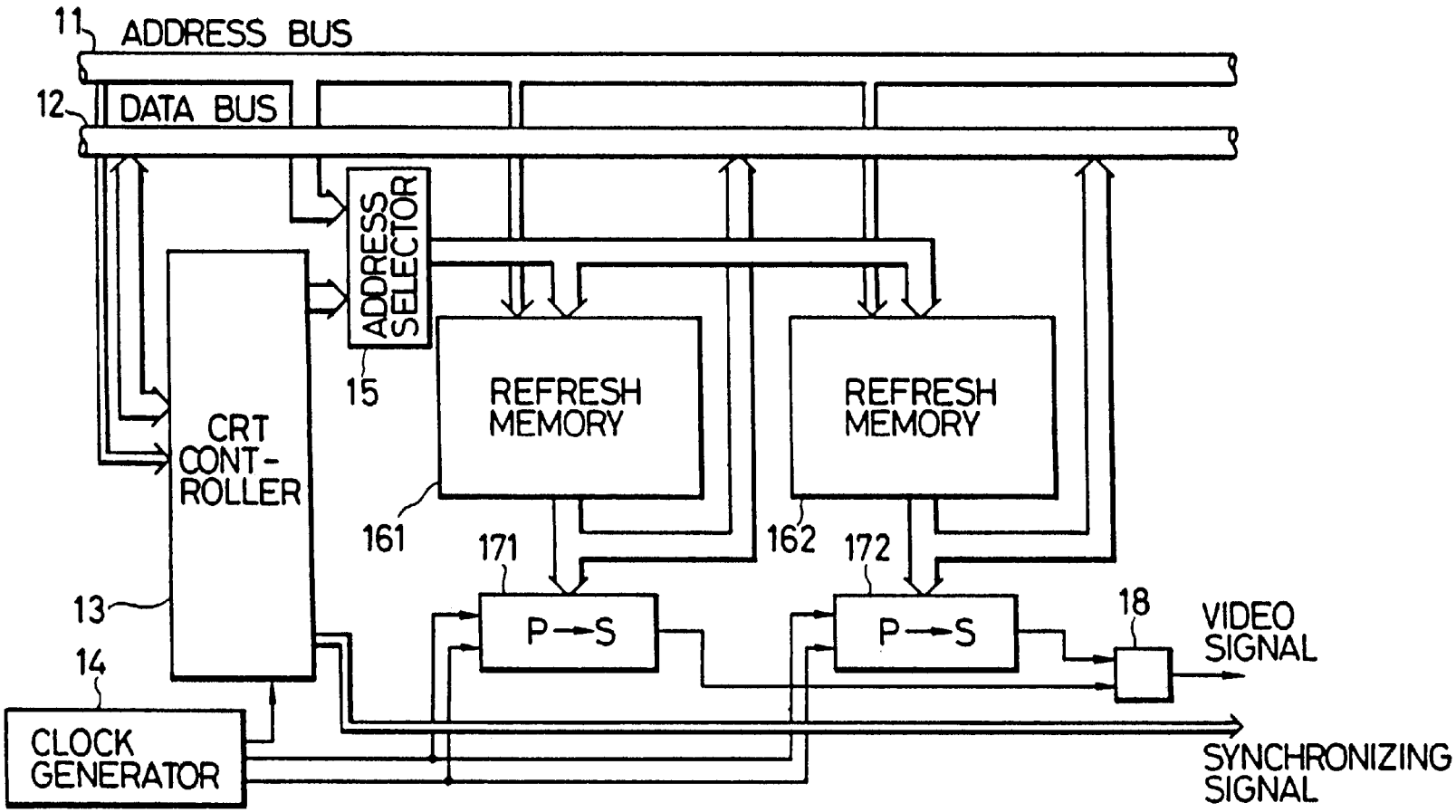
FIG. 1 PRIOR ART
FIGS. 1 and 2 show the system constructions of the prior art.
Figure 2:
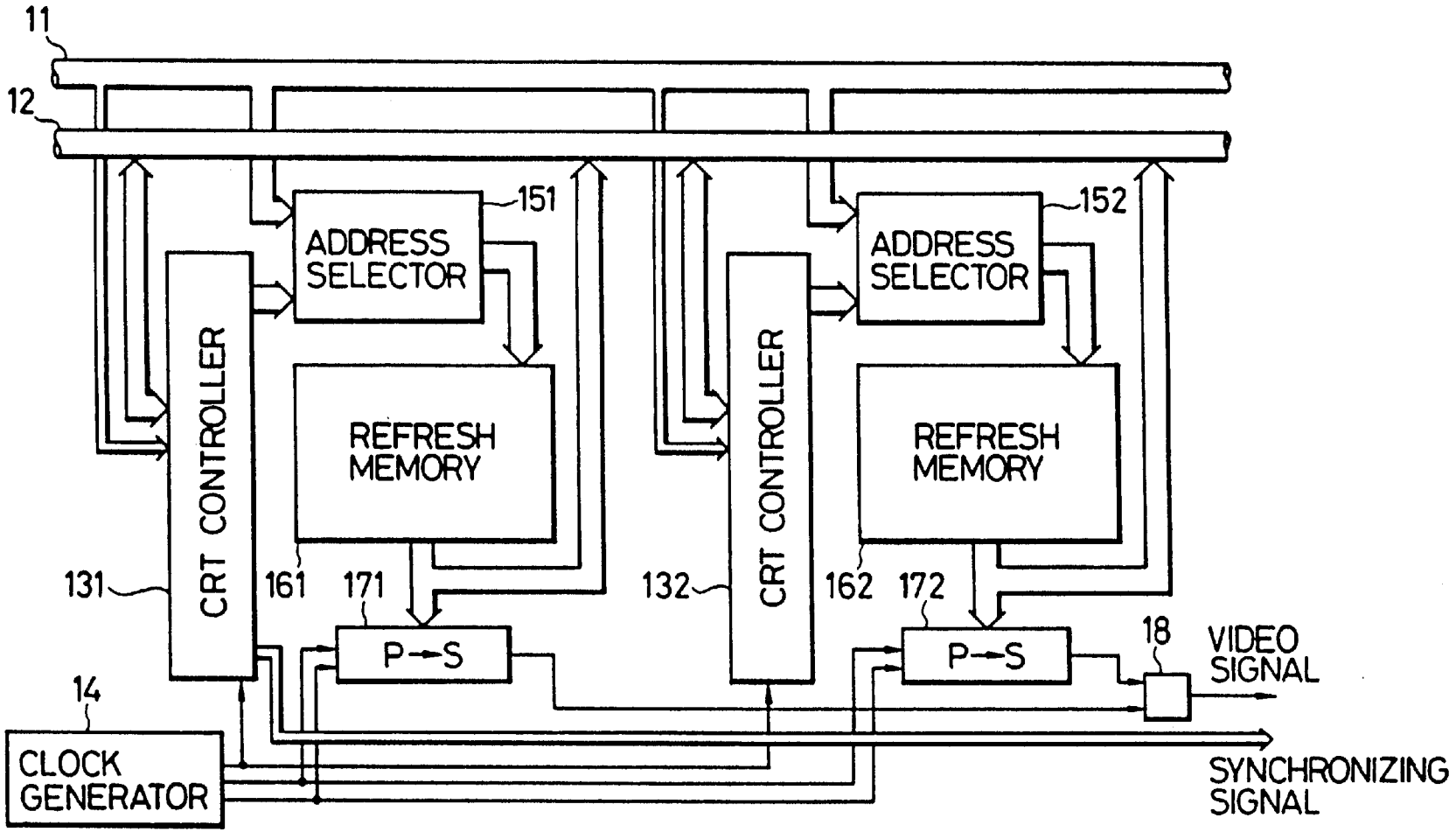
FIG. 2 PRIOR ART
Figure 3:
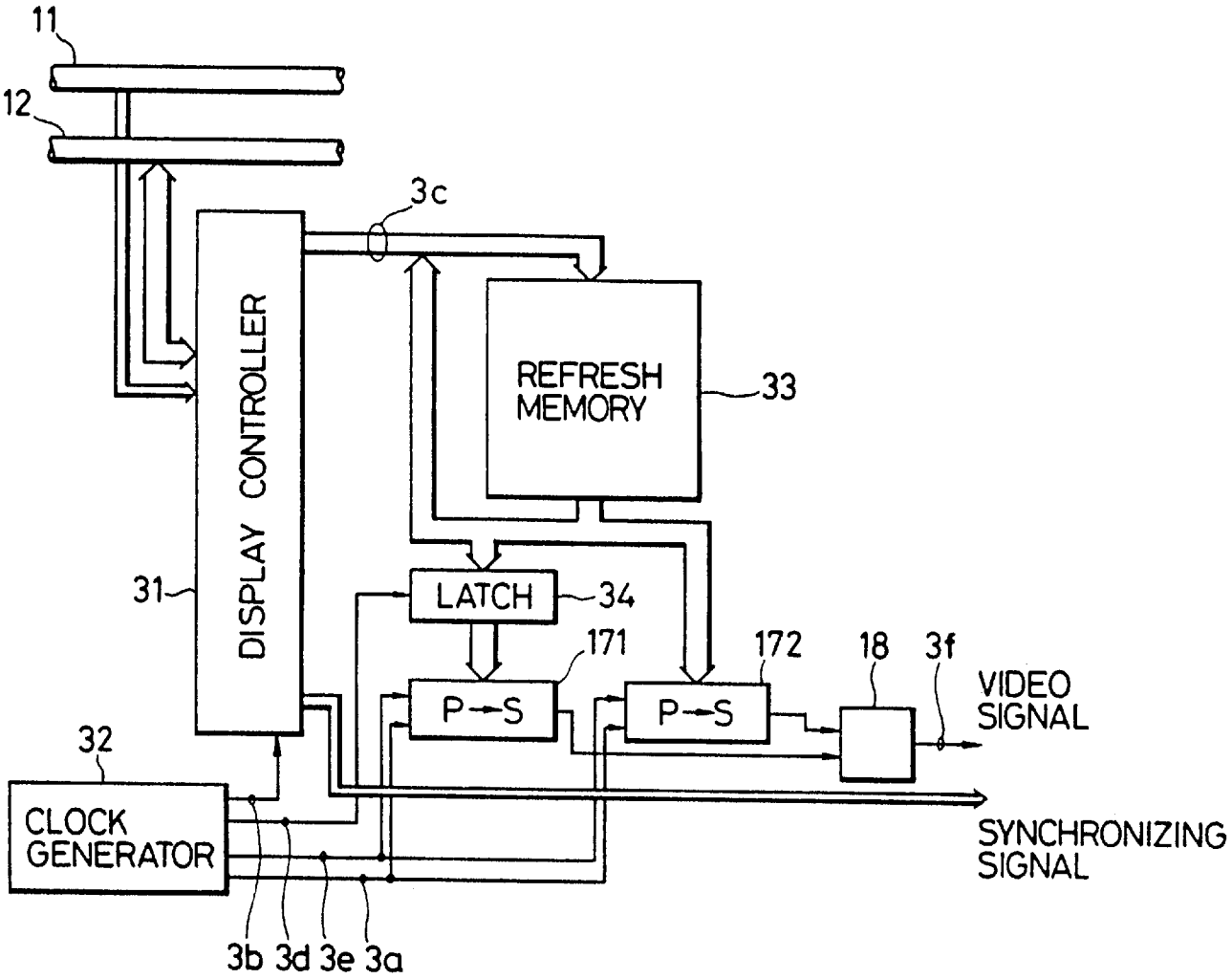
FIG. 3 shows the system construction using the display controller according to the present invention.

FIG. 3 shows an example in which the display system is constructed by using the display controller according to the present invention. In this example, the display system is constructed of a display controller 31, a clock generator 32, a refresh memory 33, a latch 34, parallel-series converters 171 and 172, and a synthesizing circuit 18. The display system has a simpler construction than that of the prior art example shown in FIGS. 1 and 2.

1.1. Summary of Operations

The display controller 31.is connected with the address bus 11 and the data bus 12 of the CPU to transfer a variety of control data. A refresh memory bus 3*c* and the CPU buses 11 and 12 are isolated so that all the accesses from the CPU side are conducted through the display controller 31. The refresh memory bus 3*c* provides the multiplex bus of the addresses and the data. The clock generator 32 provides a variety of clock signals to be used in the system, for example, a dot clock 3*a*, a drive clock 3*b* of the display controller 31, a first phase data load timing 3*d* and a second phase data load timing 3*e*. In the mode of superposing the two (i.e., n=2) frames, the memory accesses are conducted twice (i.e., n times) during one display period so that the two independent picture data are sequentially read out. In the case of the three frames, three memory accesses are conducted during one display period. Higher number of frames involve proportionally a higher number of accesses.

1.2. Time Chart

FIG. 4 shows the time chart in the case where the controller of the present invention shown in FIG. 3 is used. A 16-dot cycle in one display is used in which two memory accesses are conducted. The read-out data in the first phase are temporarily stored in the latch 34 at the first phase load timing 3*d*. The parallel-series converter 172 is stored at the second phase load timing with the read-out data in the second phase. Simultaneously with this, the parallel-series converter 171 is loaded with the content of the latch 34. The contents of the two parallel-series converters 171 and 172 are simultaneously converted into series data and are superposed in the synthesizing circuit 18 to output a composed video signal 3*f*.

1.3. Characteristics

As has been described with reference to FIG. 3, the controller of the present invention has an interfacing function with a general purpose microprocessor (i.e., MPU) and can be connected as one of the peripheral LSIs.

All the accesses of the frame memory accompanying the display control and the drawing control are administered by the controller itself of the present invention.

In order to process many data, parallel operations are conducted. These operations require separation of the system bus and the frame memory bus to conduct the software processing of the microprocessing unit and the drawing processing of the controller independently of each other.

The data transfers between the main memory and the frame memory are effected through independent word construction. In read and write FIFOs of 8 many prior art devices, the increase in the overhead of the MPU bus causes a bottleneck. In the data communication between the MPU space and the frame memory, however, the load upon the MPU bus is remarkably reduced by using highly compressed data.

2. Internal Construction

FIG. 5 shows the internal construction of the display controller 31. This display controller 31 is constructed of a drawing processor 51, a display processor 52, a timing processor 53, a CPU interface 54 and a display interface 55, which constitute individual blocks.

The drawing processor 51 controls the operations, for example, of making drawings such as lines or planes, or data transfer between the CPU and the refresh memories to output drawing addresses to read and write the refresh memories.

The display processor 52 outputs those display addresses of the refresh memories, which are sequentially displayed in accordance with the raster scanning operations.

The timing processor 53 provides a variety of timing signals such as a CRT synchronizing signal, a display timing signal for switching the displaying and drawing operations.

The CPU interface 54 dominates the interface with the CPU such as the synchronization between the CPU data bus and the CRT controller. The display interface 55 controls the interface between the refresh memories and the display system such as the address switching control of the displaying and drawing operations. The three drawing, displaying and timing processors share their functions and operate in parallel thereby to improve the processing efficiency.

2.1. Drawing Processor

Table 2 tabulates representative drawing commands of the drawing processor. The commands are composed of command codes of one word (i.e., 16 bits) and successive parameters of several words. The addresses of the coordinate points of the parameters can use either the addresses of absolute values with respect to an origin or the addresses of relative values with respect to a current pointer (i.e., CP). The present controller is caused to execute the command processings by transferring the command parameters from the MPU to the write FIFO. If the FIFO is vacant, a next command can be sequentially written. The command transfer from the MPU can use not only the writing function by a program I/O but also a DMA (i.e., a direct memory access) function.

TABLE 2

Representative Drawing Commands

| Commands | Parameters | Functions |
|---|---|---|
| AMOVE | X, Y | Shifts of current |
| RMOVE | DX, DY | point (CP) |
| ALINE | X, Y | Drawing of straight |
| RLINE | DX, DY | lines |
| ARCT | X, Y | Drawing of |
| RRCT | DX, DY | rectangles |
| APLL | n, X, Y, —, Xn, Yn | Drawing of group of |
| RPLL | n, DX, DY, —, DXn, DYn | straight lines |
| APLG | n, X, Y, —, Xn, Yn | Drawing of polygons |
| RPLG | n, DX, DY, —, DXn, DYn | |
| CRCL | R | Drawing of circles |

TABLE 2-continued

Representative Drawing Commands

| Commands | Parameters | Functions |
|---|---|---|
| ELPS | a, b, DX | Drawing of ellipses |
| AARC | Xc, Yc, Xe, Ye | Drawing of arcs |
| RARC | DXc, DYc, DXe, DYe | |
| AEARC | a, b, Xc, Yc, Xe, Ye | Drawing of |
| REARC | a, b, DXc, DYc, DXe, DYe | elliprical arcs |
| AFRCT | X, Y | Painting-out (or |
| RFRCT | DX, DY | tiling) of square regions |
| PAINT | | Painting-out (or tiling) of closed regions |
| DOT | | Drawing of one dot |
| PTN | | Drawing of patterns |
| AGCPY | Xs, Ys, DX, DY | Copying of square |
| RGCPY | DXs, DYs, DX, DY | regions |

2.2. Timing Processor and Display Processor

Now, the timing processor 53 (FIG. 5) receives the clock via the display interface 55 thereby to output a variety of timing signals necessary for the display. The detail (FIG. 6) of the internal construction of the timing processor 53 will be described hereinafter.

The timing processor 53 generates synchronizing signals necessary for the display such as horizontal and vertical synchronizing signals or a letter synchronizing signal indicating a one-letter display period and a displaying address generating timing signal at such a timing as is prepared by dividing the one-letter display period by n.

The period for which this timing signal is being generated is called "one memory cycle". How long the one memory is made, i.e., how large the integer n is made, is determined by the number of the frames to be superposed.

The timing processor 53 stores in its internal memories (i.e., registers) the data n, which are sent from the CPU (although not shown) via the CPU interface 54, to generate the timing signals matched with the data n. The timing processor 53 also in its individual internal registers with other data for generating the synchronizing signals.

The display processor 52 generates the display addresses in synchronism with the display address generating timing, which is generated by the timing processor 53, and feeds them via the display interface 55 to the refresh memory 33 (FIG. 3). The detail (FIG. 15) of the internal construction of the display processor 52 will be explained hereinafter.

The display processor 52 stores with the n groups of display starting addresses so as to sequentially generate the n groups of display addresses during a one-letter display period and computes the increments of the n groups of individual display address whenever the generating timing signals are generated in the timing processor 53, to generate the individual display addresses as the sums of those increments and the display starting addresses stored.

The generated individual display addresses are outputted via the display interface 55 to the refresh memories. The data necessary for the operations in the display processor 52 are stored in the internal memories or registers via the CPU interface 54.

The drawing processor 51 is used when the data to be displayed are stored in the refresh memories so as to effect the so-called "displaying (or drawing) operation".

2.3. Timing Processor (1) Construction

Figure 6:
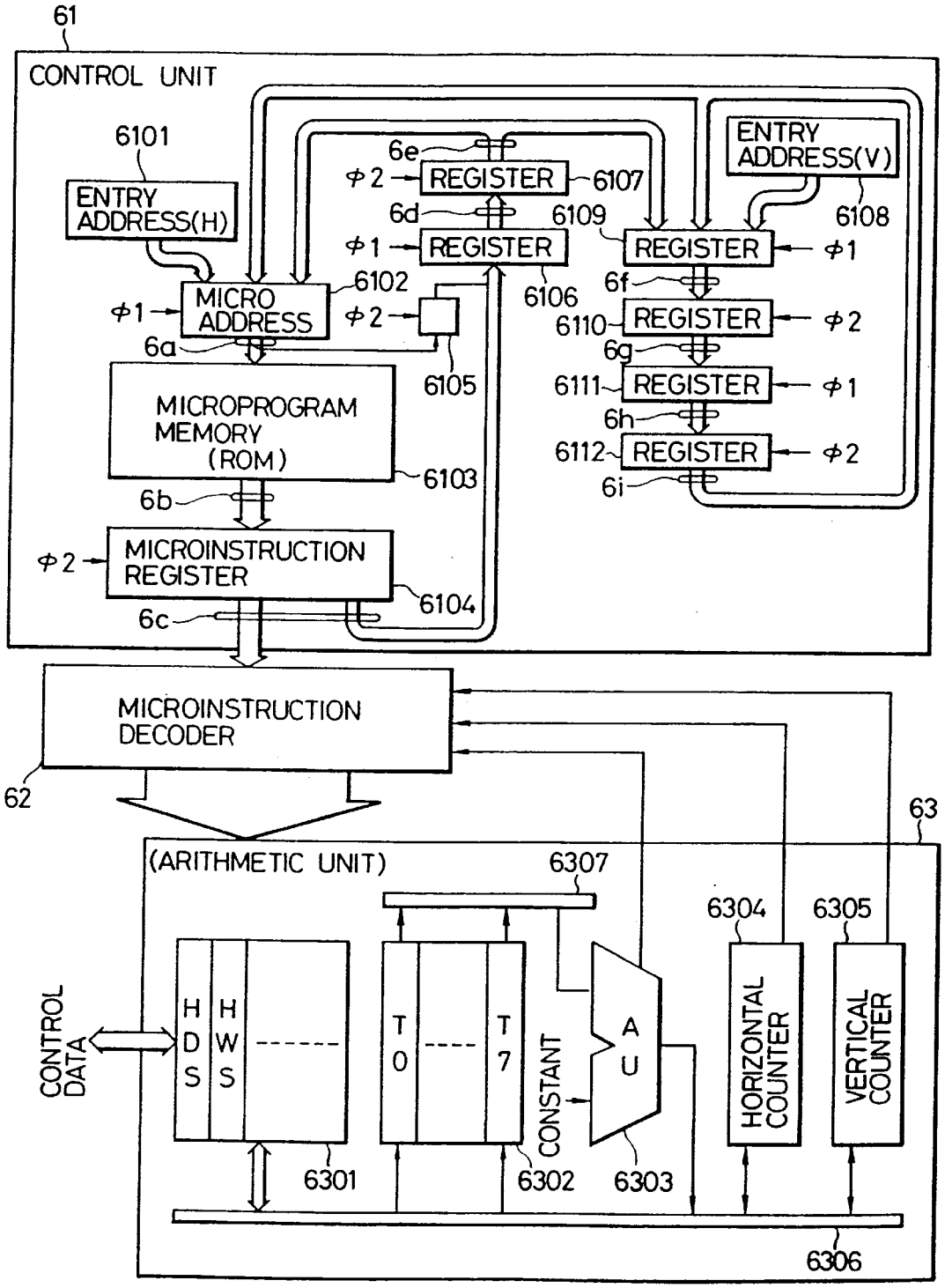
FIG. 6 shows the construction of the timing processor.

FIG. 6 shows the detailed construction of the timing processor 53. The timing processor 53 is constructed of a control unit 61, a microinstruction decoder 62 and an arithmetic unit 63. Moreover, the control unit 61 is constructed of a horizontal entry address pointer 6101, a microprogram address register 6102, a microprogram memory (of ROM) 6103, a microinstruction register 6104, registers 6105, 6106 and 6107, a vertical entry address pointer 6108, and registers 6109, 6110, 6111 and 6112.

The arithmetic unit 63 is constructed of: a data RAM 6301 for storing the control data transferred from the CPU; a working register 6302; an arithmetic unit (AU) 6303; a horizontal counter 6304 for counting the timings of the horizontal system to generate the horizontal synchronizing signal; a vertical counter 6305 for counting the raster timings of the vertical system to generate the vertical synchronizing signal; and buses 6306 and 6307.

The detail of the microinstruction decoder 62 itself will be described hereinafter. The signals $\phi$1 and $\phi$2 are the timing signals of FIG. 7. The legends 6*a*–6*i* identify signals in FIG. 7. Registers $T_0$–$T_7$ of the working register 6302 are coupled to bus 6307.

(2) Time Chart

Figure 7:
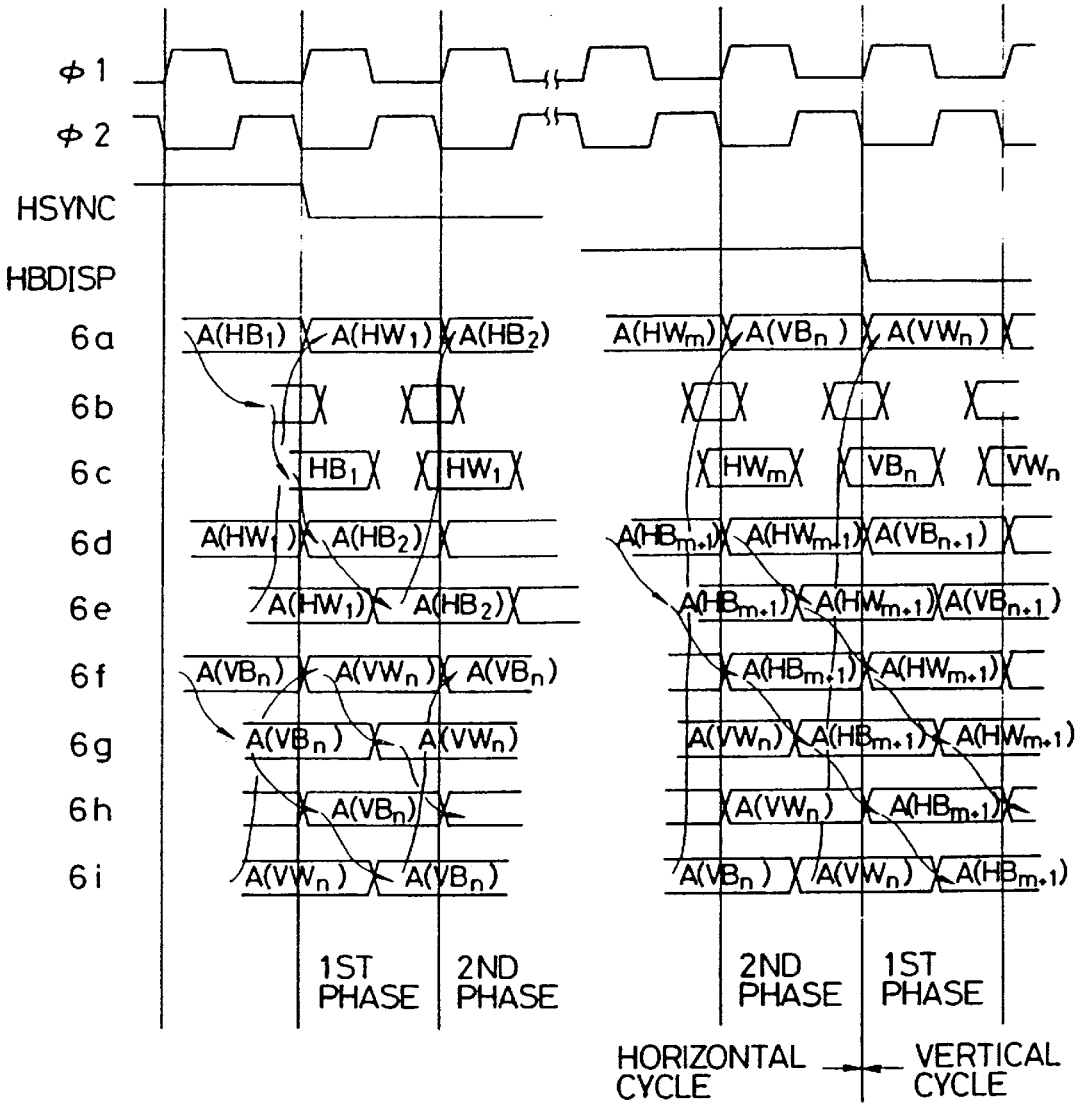
FIG. 7 shows the time chart of the operations.

FIG. 7 shows a time chart corresponding to FIG. 6. At the start of the vertical synchronizing signal, the register 6109 is initialized to an initial value A(VBl in the first phase and to an initial value A(VW1 in the second phase by the vertical entry address pointer. The vertical addresses in the first and second phases are stored by the closed loop of the registers 6109, 6110, 6111 and 6112.

At the start of the horizontal synchronization, on the other hand, the microprogram address register 6102 is initialized to A(HB1) in the first phase and to A(HW1) in the second phase by the horizontal entry address pointer 6101. After that, in synchronism with the fall of a horizontal synchronizing signal (HSYNC), the microprogram operations are started so that the corresponding microinstructions are read out from the microprogram memory 6103 in accordance with the instruction of the microprogram address register 6102 and are stored in the microinstruction register 6104. The microinstructions thus read out are decoded by the microinstruction decoder 62 to feed the various control signals to the arithmetic unit 63.

On the other hand, a portion of the microinstructions are stored as a subsequent address temporarily in the memory register 6106. One bit of the microprogram address is a bit indicating whether the microprogram address is that of the horizontal cycle or the vertical cycle. This bit is returned via the register 6105 to one bit of the register 6106.

In the cycle $\phi$ in which the subsequent address in the first phase is taken into the register 6106, the microprogram address in the second phase is transferred to the microprogram address register 6102 to read out and execute the corresponding microinstructions. The subsequent address stored in the register 6106 is sent via the register 6107 to the microprogram address register 6102. Thus, the microprogram in the first phase and the microprogram in the second phase are sequentially and alternately executed.

In case the microprogram of the vertical cycle is to be executed, the input is switched between the microprogram address register 6102 and the register 6109 in accordance with the designation from the microinstructions. Specifically, the addresses A($VB_n$) and A($VW_n$) of the vertical microprogram, which are stored in the registers 6109 and 6112, are sequentially sent during the one cycle between the first and second phases to the microprogram address register 6102. Simultaneously, the subsequent addresses A($HB_{m+1}$) and A($HW_{m+1}$) of the horizontal microprogram are sequentially sent to the register 6109 until they are stored in the loop of the registers 6109 to 6112. As a result, the independent microprograms for four phases, i.e., the first and second horizontal phases and the first and second vertical phases can be executed in a time sharing manner.

(3) Microprograms

Figure 8:
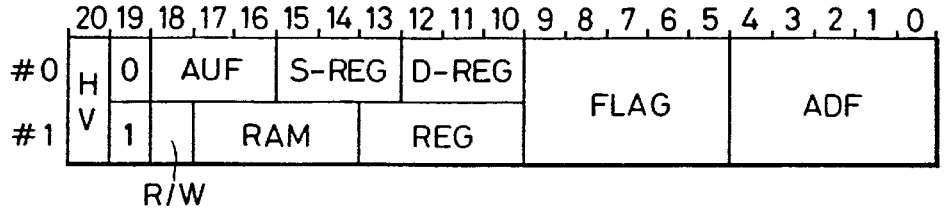
FIG. 8 shows the microinstruction types of the same.

FIG. 8 shows the types of the microinstructions. The word length is 21 bits and has two types #0 and #1 which are selected by a bit 19.

A bit 20 (HV) is for controlling the interchange between the horizontal microprogram addresses and the vertical microprogram addresses. Bits 18 to 10 have different functions for two microinstructions. The microinstruction of the type #0 controls the operations for working register 6302. Specifically, data are read out from the register designated by a microinstruction S-REG, and the operations designated by a microinstruction AUF are conducted to write the result in the register designated by a microinstruction D-REG. The microinstructions of the type #1 control the data transfers among the data RAM 6301, the working register 6302, and the horizontal and vertical counters 6304 and 6305. The, microinstruction FLAG of bits 9 to 5 designates both the control of the flag information outputted from the AU and the counters and the control of conditional branch. The microinstruction ADF of bits 4 to 0 is a field for controlling the subsequent address of the microprogram.

In FIG. 8. the term AUF identifies the arithmetic unit field and the term S-REG identifies the source register.

Figure 9:
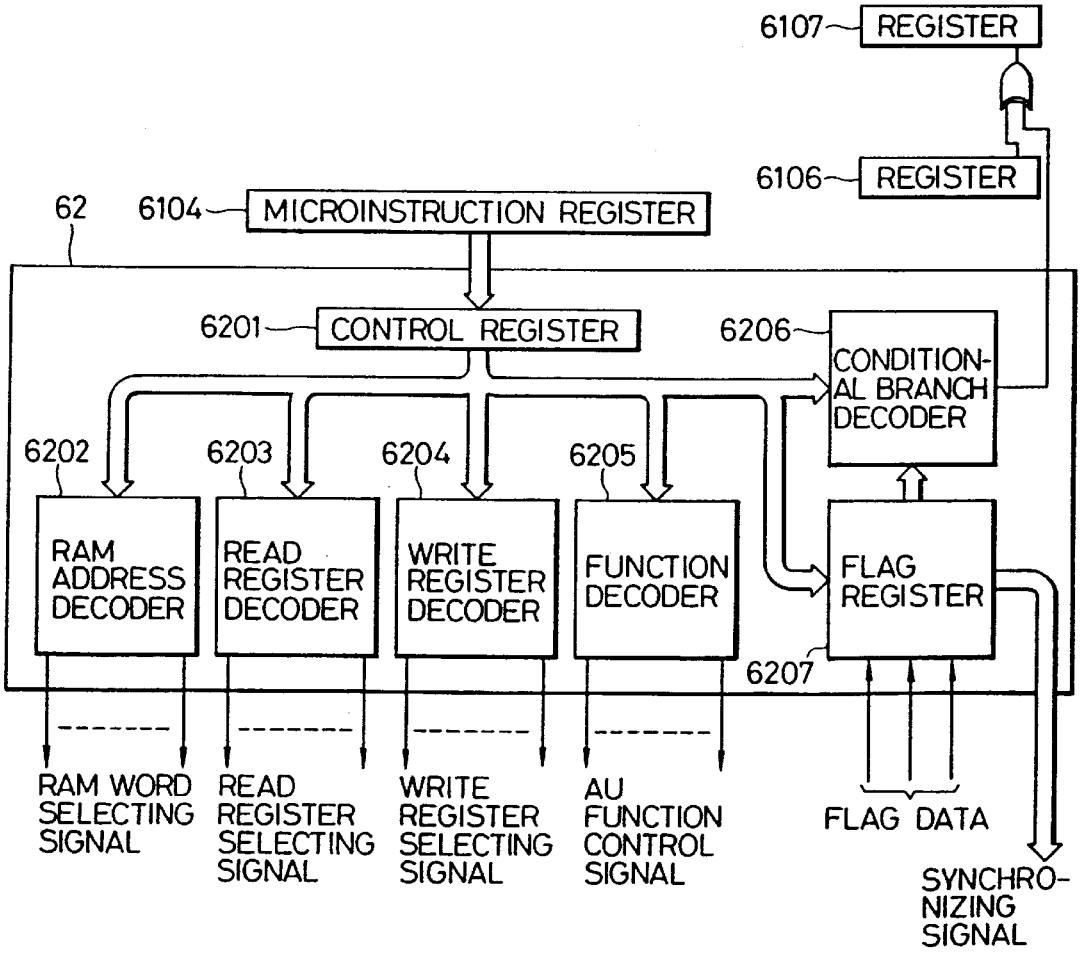
FIG. 9 shows the detail construction of the microinstruction decoder.

FIG. 9 shows the detail of the microinstruction decoder 62.

The microinstruction stored temporarily in the microinstruction register 6104 is sent via a control register 6201 to decoders 6202 to 6207 of individual fields. The RAM address decoder 6202 decodes the RAM field of the microinstructions of the type #1 to generate the word selecting signal of the RAM. The read register 6203 decodes the S-REG field of the microinstruction of the type #0 to output a signal for selecting the read register to the bus 6307. The read register decoder 6204 decodes both the D-REG field of the microinstruction of the type #0 and the REG field of the microinstruction of the type #1 to output the write register selecting signal from the bus 6306. Even upon the transfer from the horizontal and vertical counters to the data RAM 6301, the reading operation to the bus 6306 is controlled by the REG field.

The function decoder 6205 decodes the AUF field of the microinstruction of the type #0 to control the arithmetic mode of the arithmetic unit (AU) 6303. The conditional branch decoder 6206 judges the status of the flag register in accordance with the designation of the FLAG field of the microinstruction to control the lowermost bit of the address, which is transferred from the register 6106 to the register 6107, thereby to make the conditional branch possible. The flag register 6207 temporarily stores the flag data, which are outputted from the adder (AU) 6303 or the counters 6304 and 6305, in accordance with the designation of the microinstruction.

The flag register has a horizontal synchronizing signal (HSYNC), a vertical synchronizing signal (VSYNC), a horizontal base frame display timing (HBDISP), a vertical base frame display timing (VBDISP), a horizontal window frame display timing (HWDISP), and a vertical window frame display timing (VWDISP)

(4) Example of Frame Structure and Flow Chart

Figure 10:
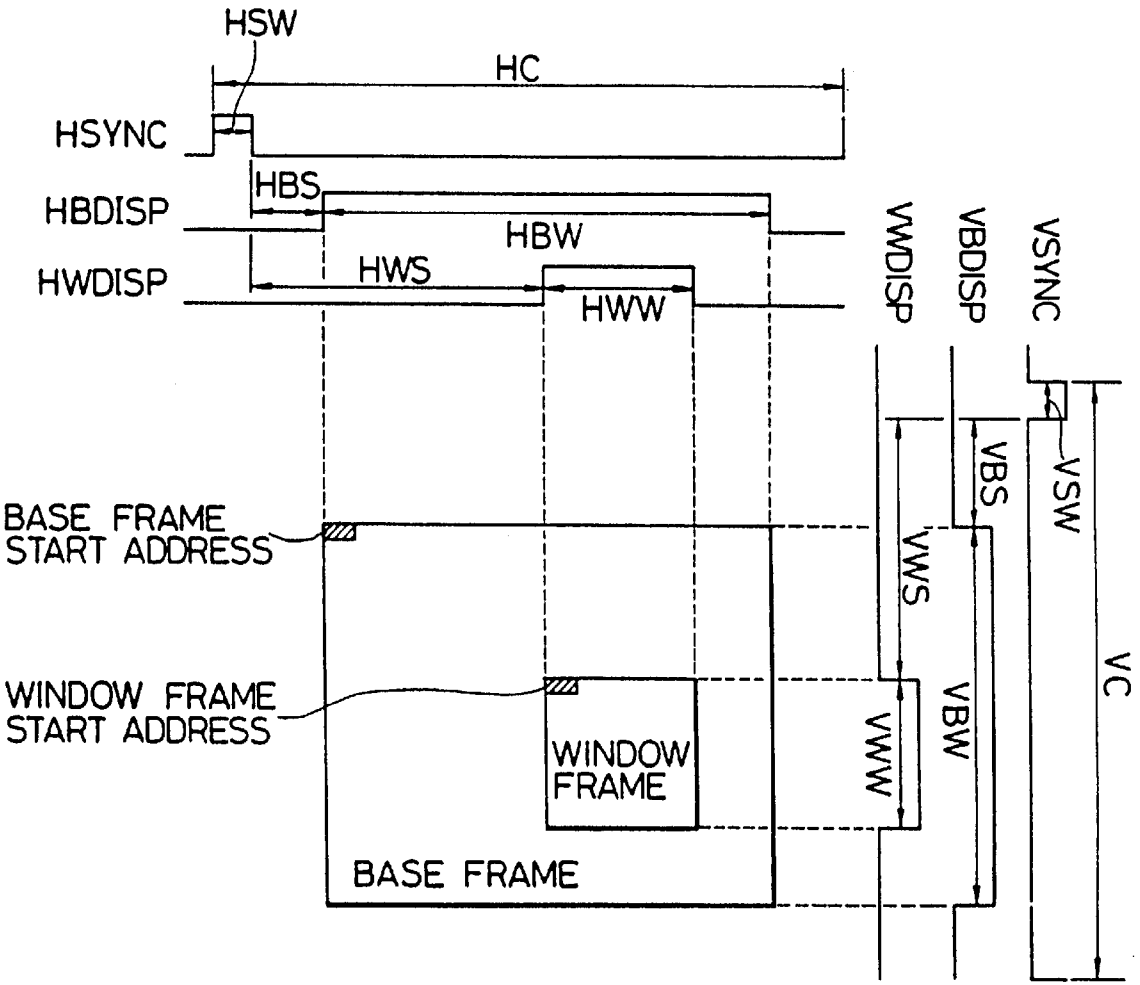
FIG. 10 shows an example of the construction of the display frame.
Figures 2A, 10:
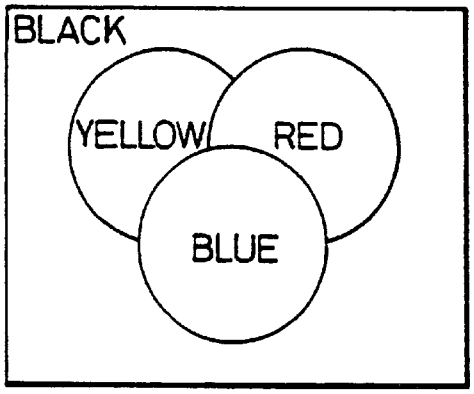
Figures 2B, 10:
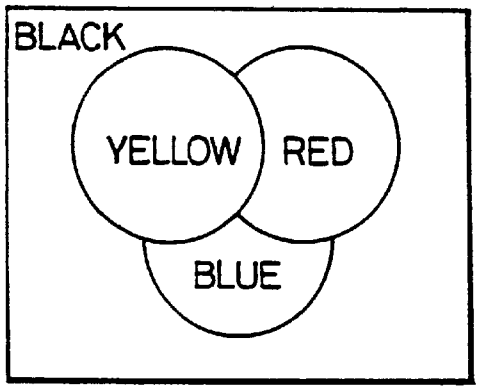
Figures 2C, 10:
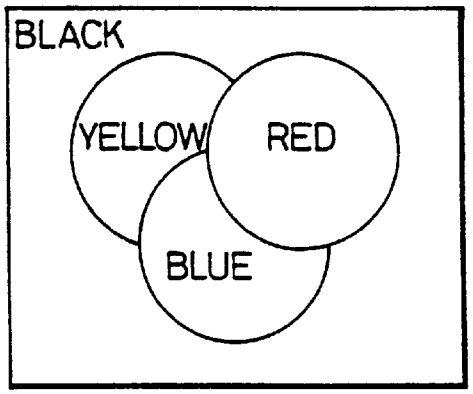
Figures 2D, 10:
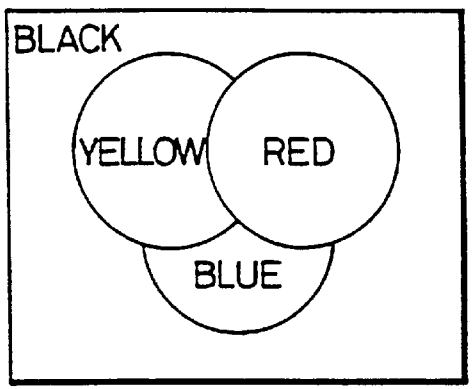
Figures 3C, 10:
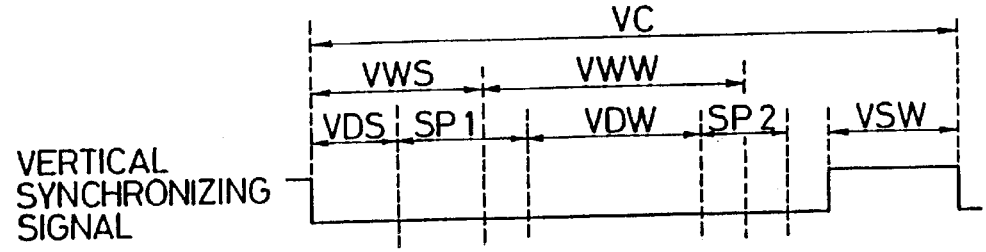
Figures 3A, 10:
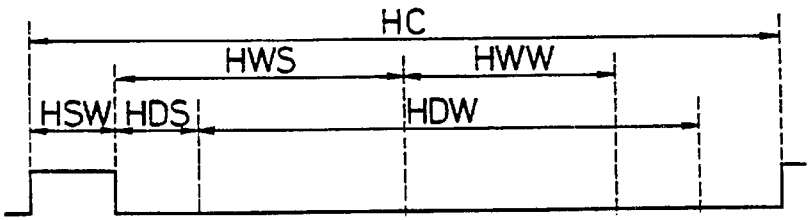
Figures 3B, 10:
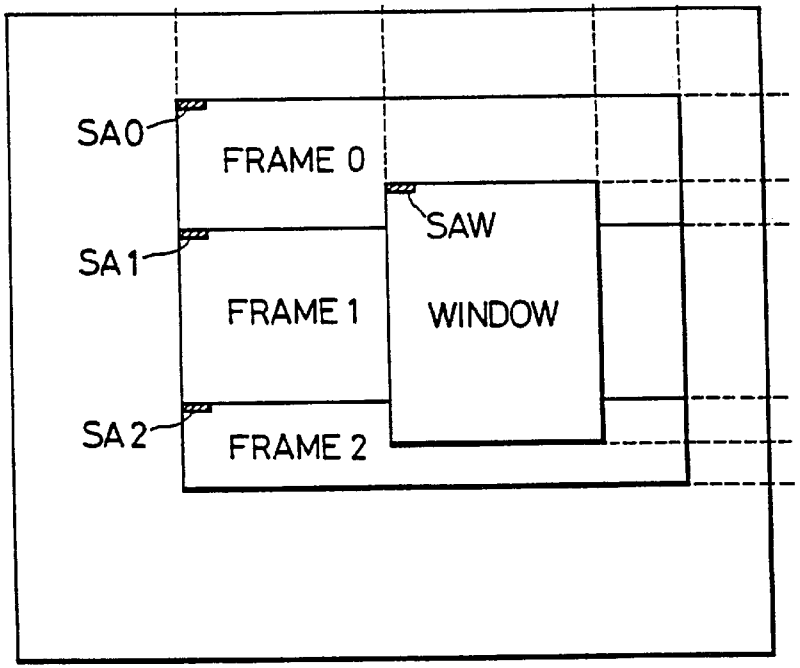
Figures 4A, 10:
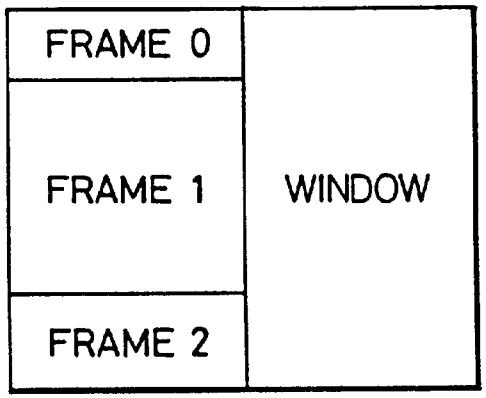
Figures 4B, 10:
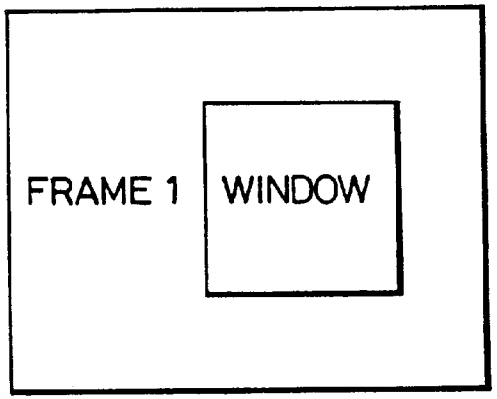
Figures 4C, 10:
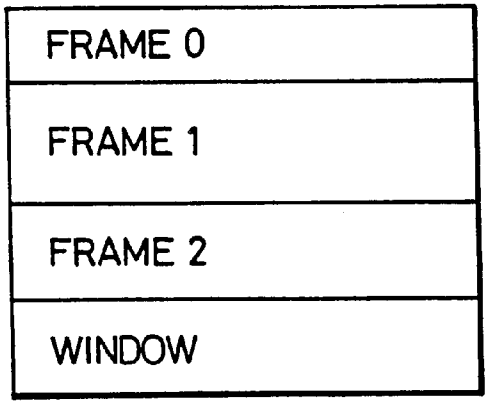
Figures 4D, 10:
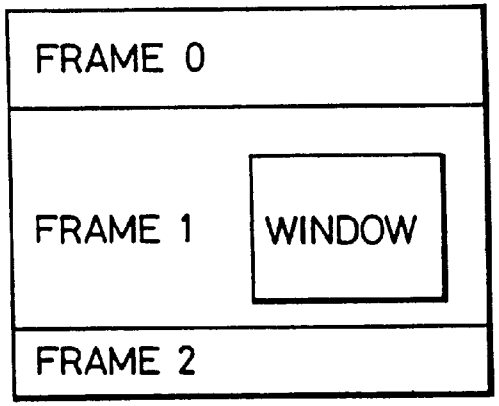

FIG. 10 shows an example of the frame structure for controlling the display controller 31. It is possible to synthesize and display two independent frames, i.e., the base frame and the window frame. These two frames can have their sizes and display positions set independently of each other. The individual parameters will be described hereinafter.

In accordance with the settings of the individual parameter values, the timing processor 53 (FIG. 5) generates the various timing signals (HSYNC, HBDISP, HWDISP, VSYNC, VBDISP, VWDISP and so on). The display processor 52 proceeds its processings with reference to those timing signals.

In FIG. 10-3 the terms SA0, SA1 and SA2 identify starting addresses and the terms SP1, SP2 identify split 1, 2.

In FIGS. 10 and 10-3 the term HC identifies horizontal cycle, the term HSW identifies horizontal sync width, the term VC identifies vertical cycle, the term HBS identifies horizontal base start, the term HBW identifies horizontal base width, the term VBS identifies vertical base start, the term VWS identifies vertical window start and the term VWW identifies vertical window start.

FIGS. 11 to 14 show examples of the microprogram processes of the timing processor 53.

Figure 11:
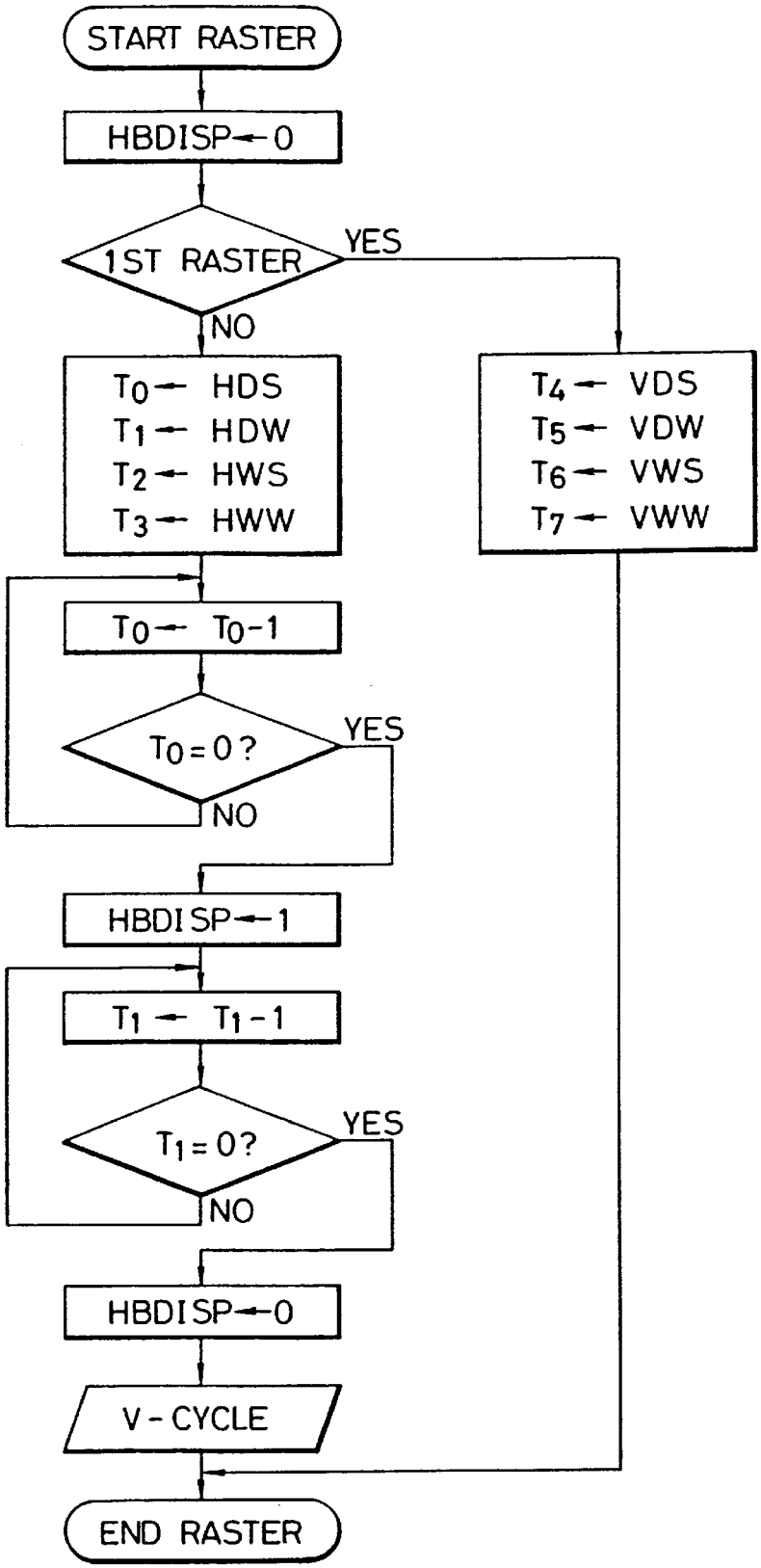
FIGS. 11, 12, 13 and 14 show the examples of the process flows of the timing processor.

FIG. 11 shows the microprogram of the horizontal first phase. At the starting point of one raster, the HBDISP flag is set at "0" to check whether it is the first raster (of the frame) or not. In the case of the first raster, the vertical parameters (VDS, VDW, VWS and VWW) are transferred from the data RAM 6301 to the working register 6302 to end the processing of the raster. In the case of a raster other than the first one, working registers T0 to T3 are first loaded with the corresponding,4orizontal control parameters (HDS, HDWJI HWS and HWW). Next, the working register T0 is sequentially subtracted until it contains "0". When the working register T0 stores "off the HBDISP flag is set at "1". After that, the working register T1 is subjected to sequentially subtracted until it contains "0". When the working register T1 contains "0", the HBDISP flag is set at "0". Then, the process is switched to the vertical one to end the processing of one raster.

Figure 12:
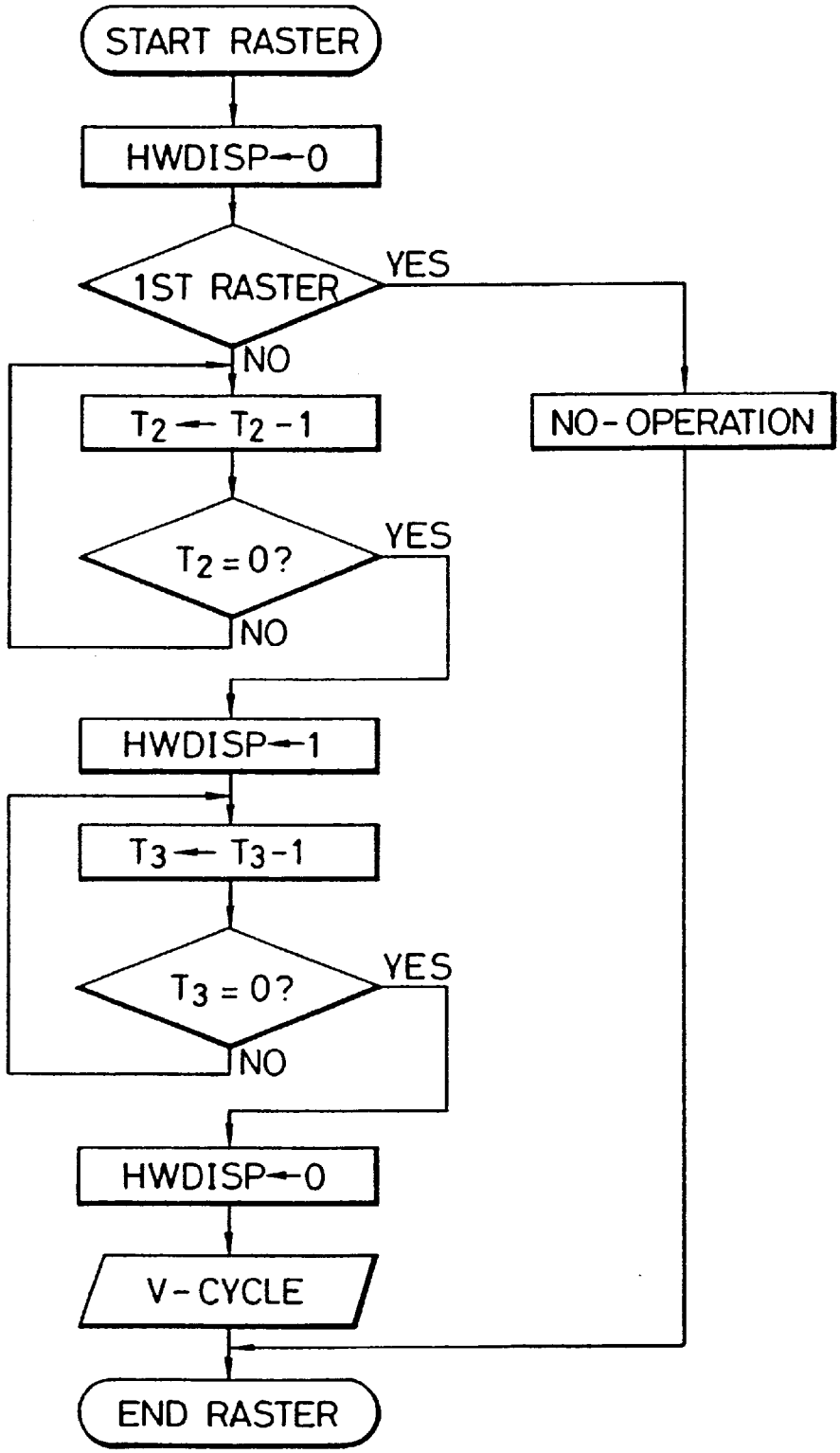

FIG. 12 shows the microprogram of the horizontal second phase, which is similar to the case of FIG. 11 except that the data RAM is not loaded.

Figure 13:
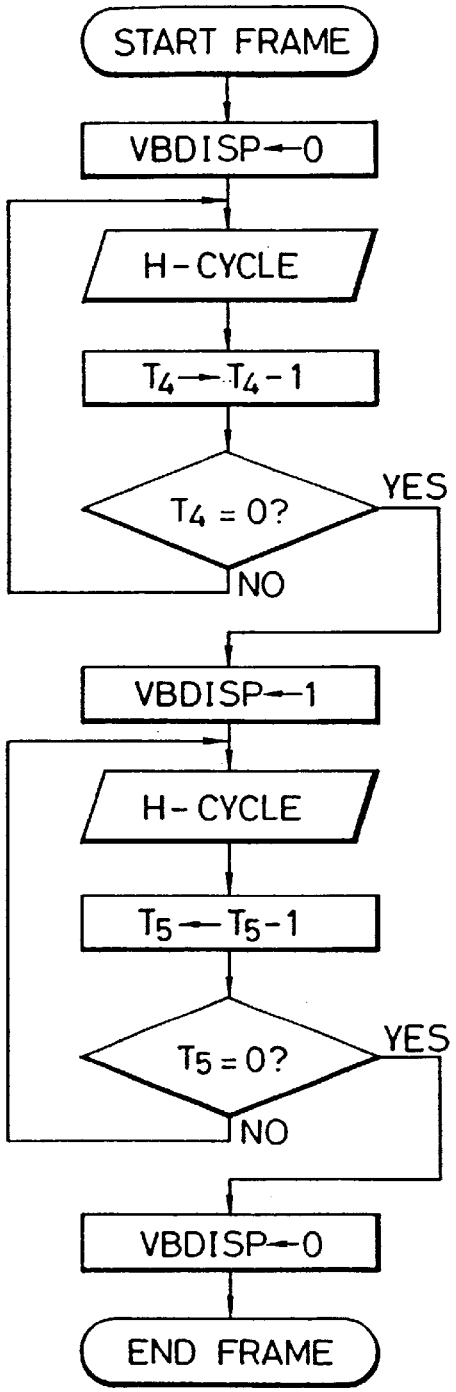
Figure 14:
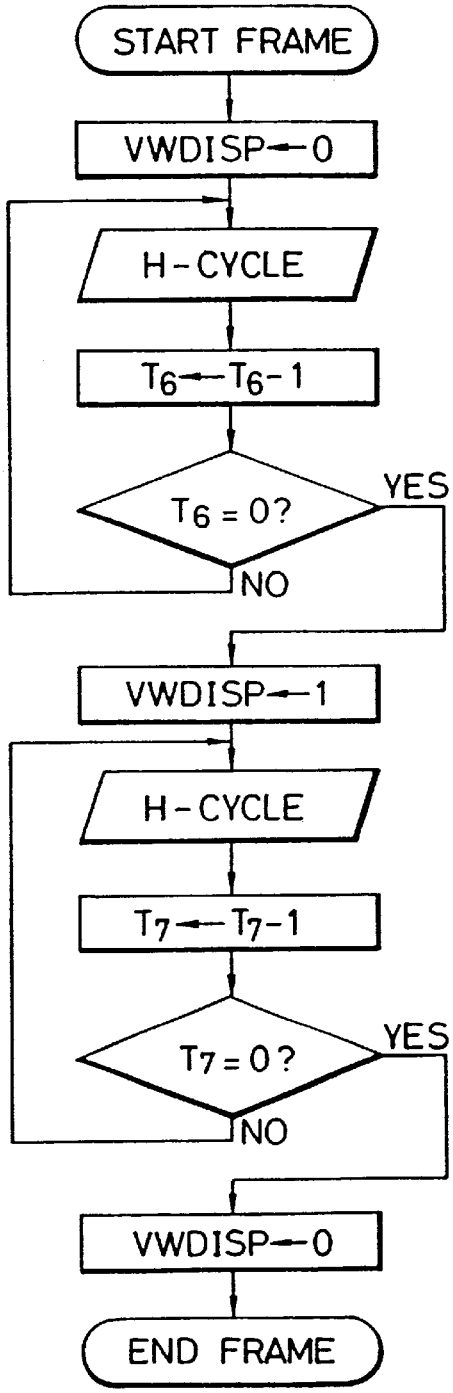

Likewise, FIGS. 13 and 14 show the microprogram processes of the vertical first and second phases, respectively. The vertical process conducts the subtraction of the working register and the "0" detection once for one raster.

As has been described above, one arithmetic unit is used in the time sharing manner for the microprograms of four phases to generate the four timing signals HBDISP, HWDISP, VEDISP and VWDISP.

2.4. Display Processor (1) Construction

Figure 15:
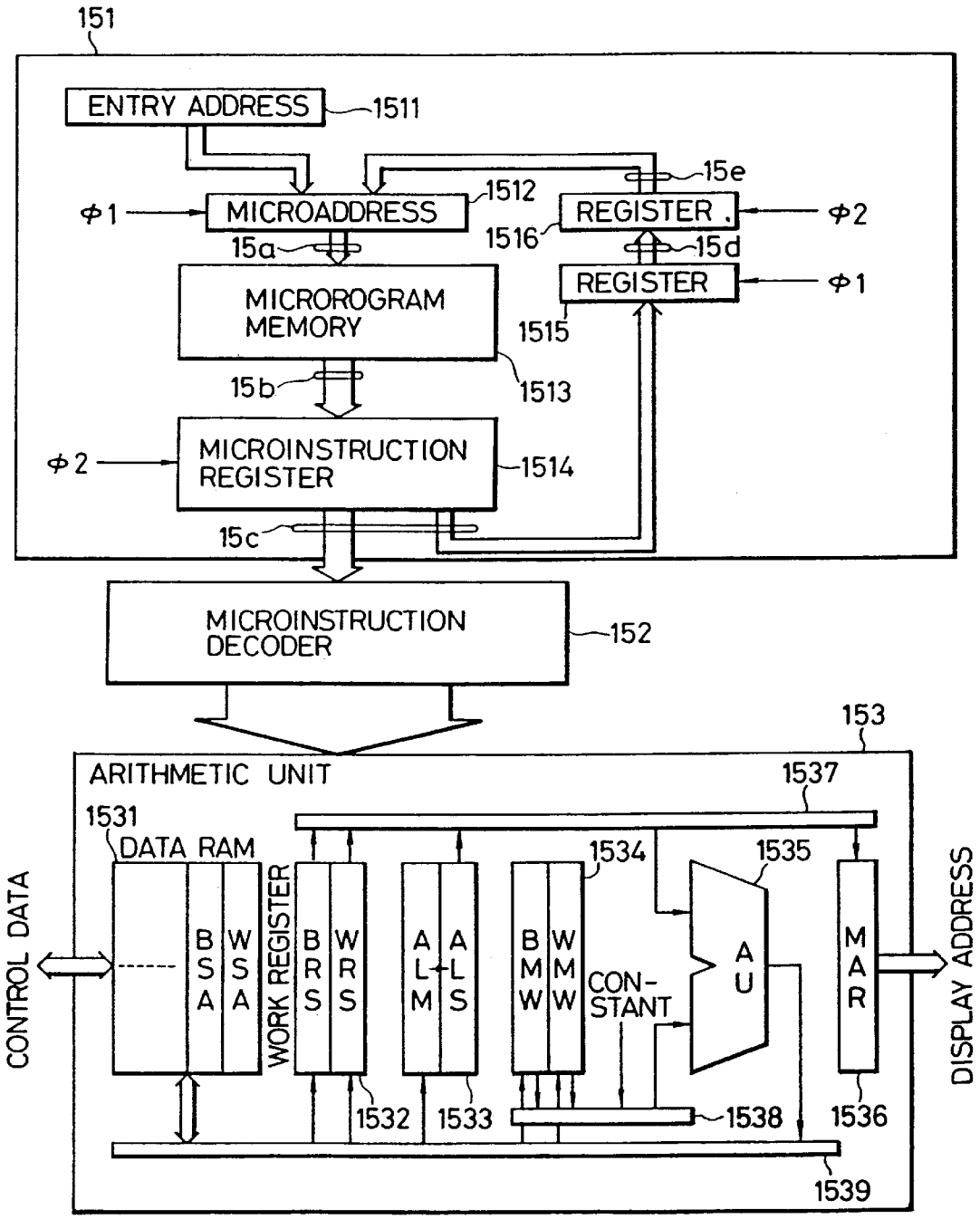
FIG. 15 shows the construction of the display processor.

The display processor outputs the display addresses. The display addresses are those of the refresh memories, which are sequentially displayed in accordance with the raster scanning operation, as has been described hereinbefore. FIG. 15 shows the detailed construction of the display processor 52 (FIG. 5). This display processor 52 is constructed of a control unit 151, a microinstruction decoder 152 and an arithmetic unit 153.

The control unit 151 is constructed of an entry address pointer 1511, a microprogram address register 1512, a microprogram memory (ROM) 1513, a microinstruction register 1514, and temporary memory registers 1515 and 1516.

The arithmetic unit 153 is composed of a data RAM 1531 adapted to be accessed directly from the CPU side via the CPU interface for storing control data such as the display starting addresses (RSA and WSA) of the base frame (i.e., the first frame) and the window frame (i.e., the second frame); a working register 1532 for storing the display addresses (BRS and WRS) at the head of one raster; a register 1533 for storing the display addresses (ALM and ALS) at present; a register 1534 for storing the increments (BMW and WMW) of the display addresses for each raster; an arithmetic unit (AU) 1535; a memory address register (MAR) 1536; an X-bus 1537; a Y-bus 1538; and a Z-bus 1539.

(2) Time Chart

Figure 16:
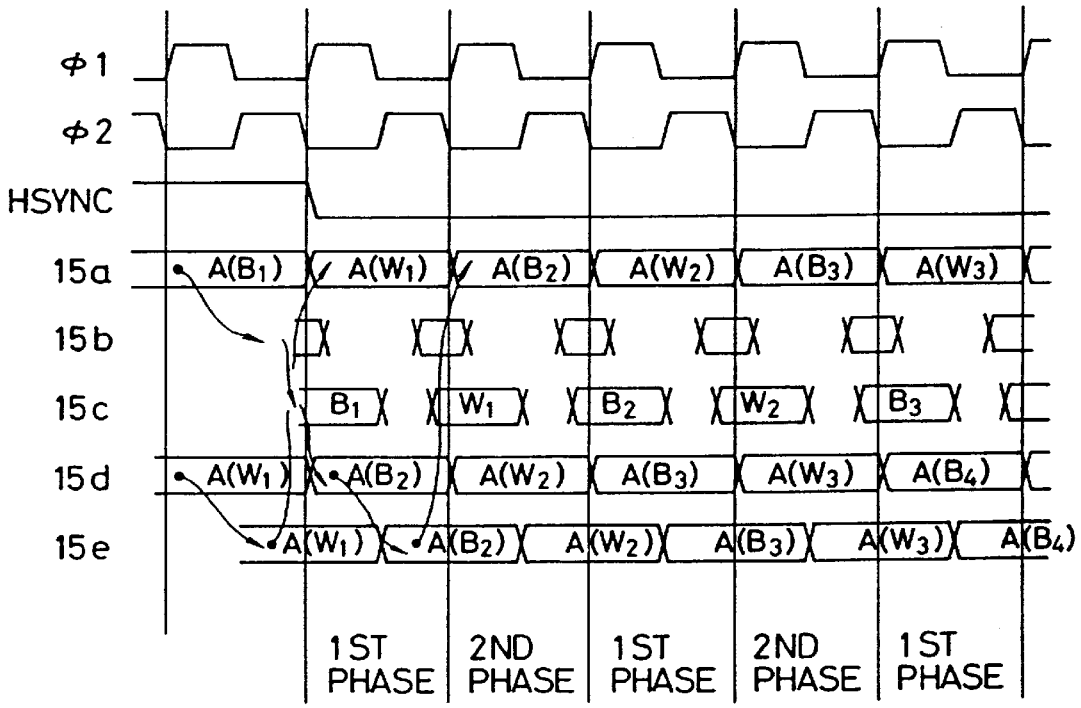
FIG. 16 shows the operation time chart of the same.

FIG. 16 shows a time chart corresponding to FIG. 15.

The horizontal synchronizing signal initializes the microprogram address register 1512 to the contents of the entry address pointer 1511. On and after the fall of the horizontal synchronizing signal (HSYNC), the microprogram ROM 1513 is accessed by the microprogram address register 1512 so that the output read out is temporarily stored in the microinstruction register 1514. This microinstruction is decoded by the microinstruction decoder 152 to feed a variety of control signals to the arithmetic unit 153. A portion of the microinstructions is returned to the temporary memory registers 1515 and 1516, the contents of which provide the addresses of the next microinstructions. Thus, the microprograms, in which addresses A(B1) and A(W1) initialized by the entry address pointer are used as the starting point, are executed in sequential and alternate manners.

(3) Microprograms and Operation Modes

Figure 17:
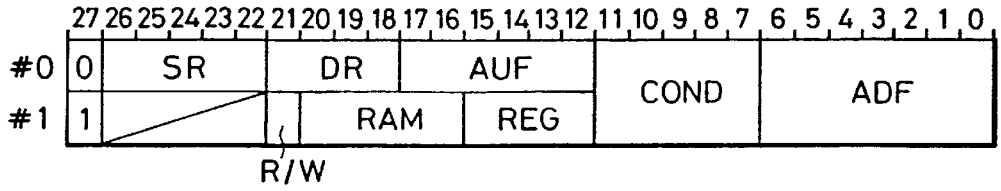
FIG. 17 shows the microinstruction types of the same.

FIG. 17 shows the microinstruction types of the display processor. The word length is 28 bits and has two types #0 and #1 which are selected by a bit 27. The microinstruction of type #0 controls the operations between the registers. On the other hand, the microinstruction of the type #1 controls the data transfers among the data RAM and the individual registers.

Figure 18:
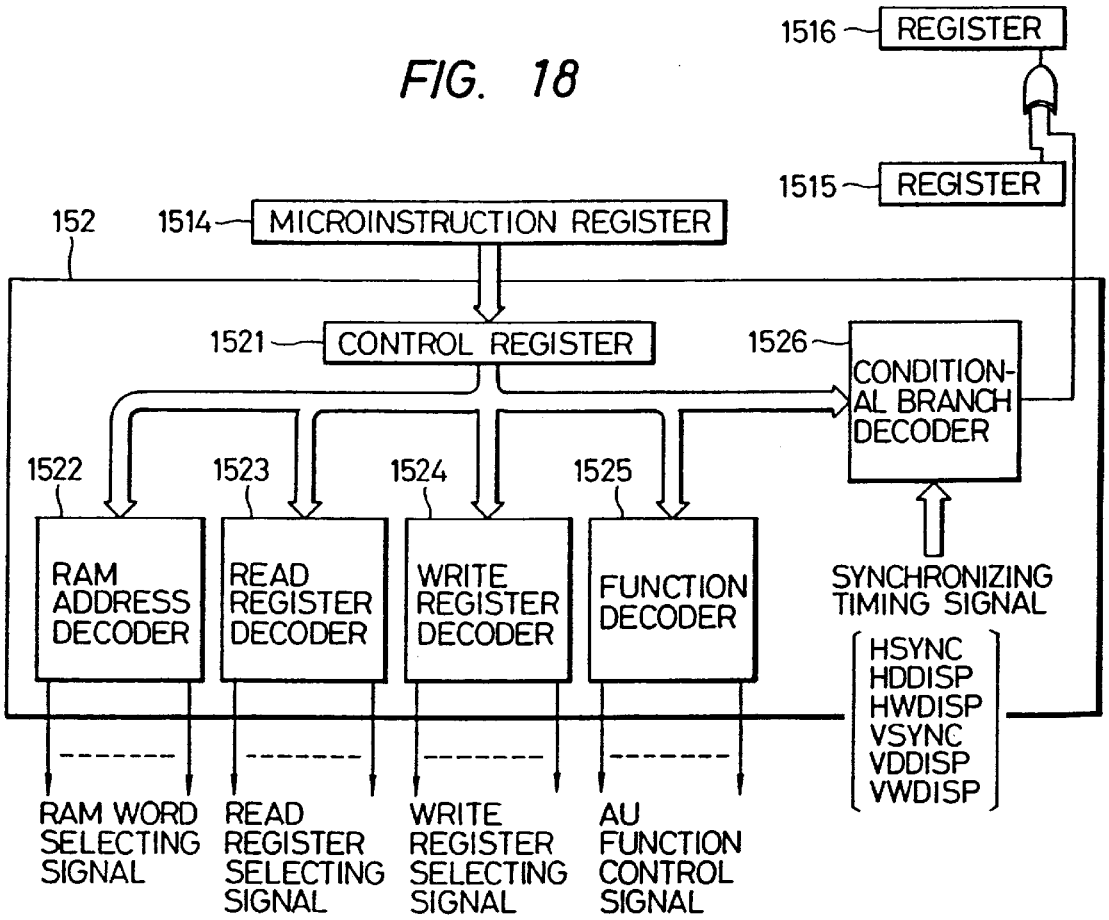
FIG. 18 shows the detail construction of the microinstruction decoder.

FIG. 18 shows the detail of the microinstruction decoder 152. This microinstruction decoder 152 is composed of the individual decoder units which are similar to those of the microinstruction decoder 62 of the timing processor shown in FIG. 9. The conditional branch decoder 1526 is controlled with reference to the synchronizing timing signal fed from the timing processor.

Figure 19A:
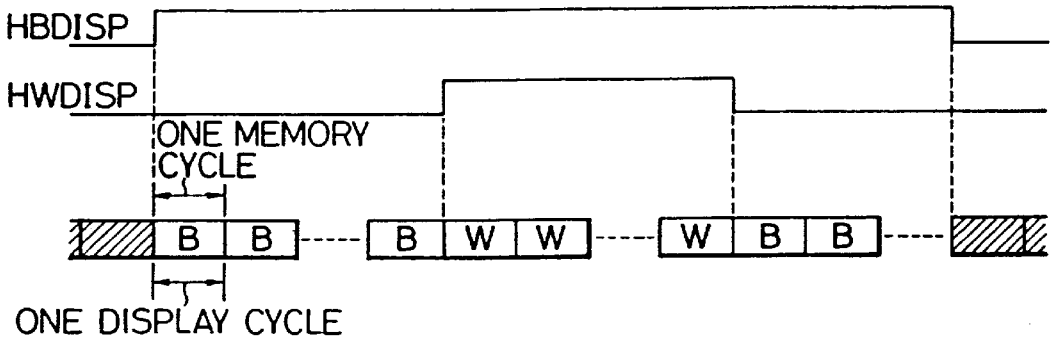
FIGS. 19(A) to (C) explain the operation modes of the display.
Figure 19B:
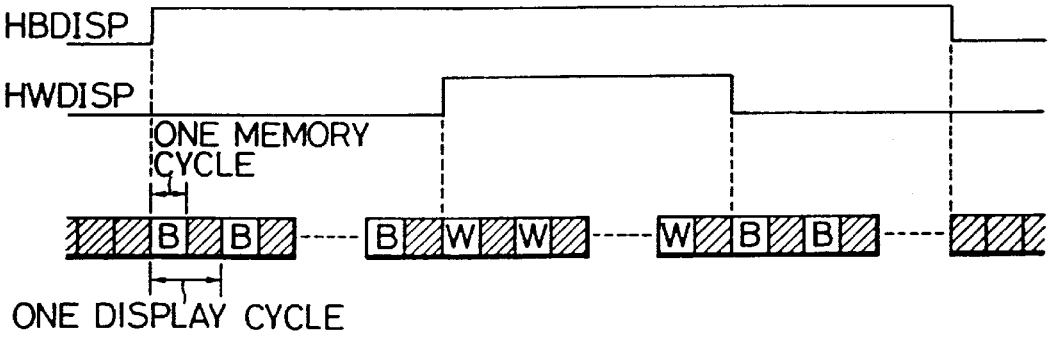
Figure 19C:
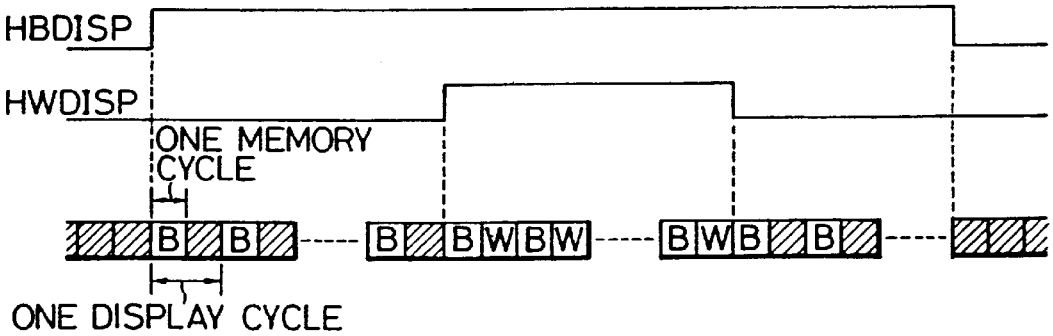

FIGS. 19(A) to (C) show three kinds of operation modes for controlling the display processor 52. In accordance with the individual modes, the CRT interface 55 suitably switches and outputs the memory address (B) of the base frame, the memory address (W) of the window address, and the drawing memory address (i.e., the hatched portion of the drawing).

Figures 2A, 19:
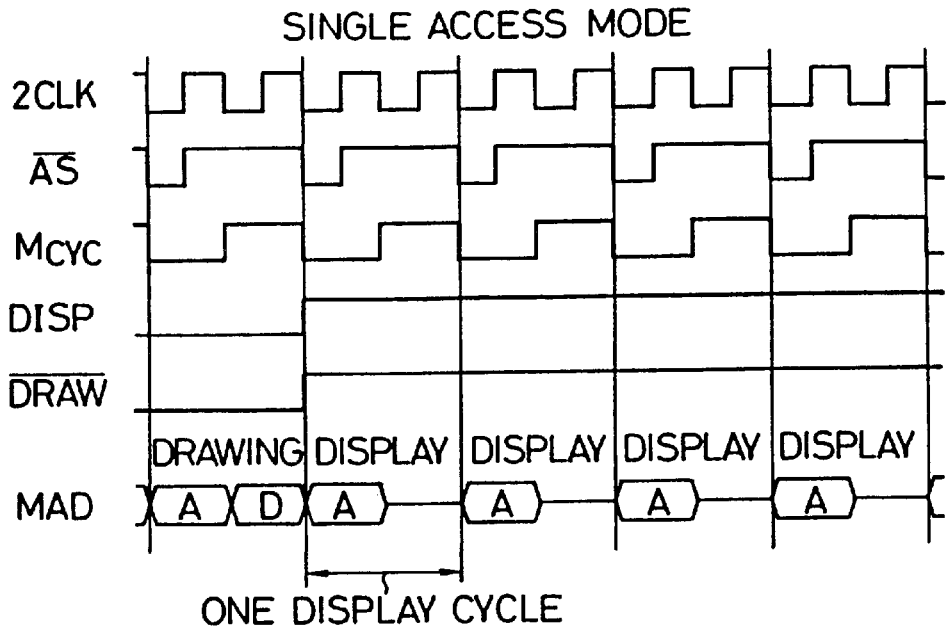
Figures 2B, 19:
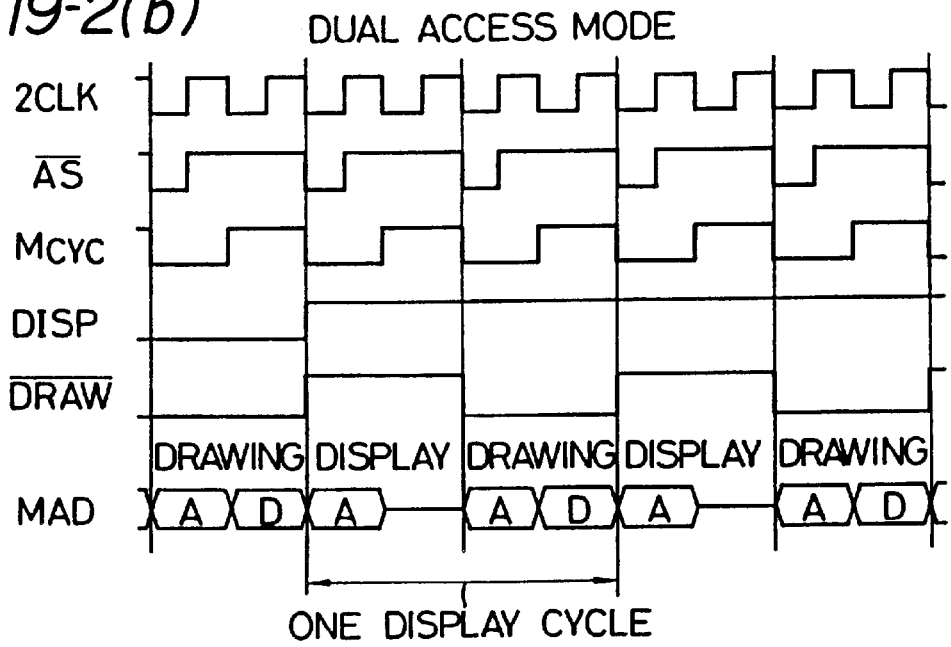

The individual modes will be briefly explained in the following:

(a) Single Access Mode (FIG. 19 (A))

This is a mode in which the display cycle and the memory cycle are made identical and processed. The switching control is made such that the memory address (B) of the base frame computed in the first phase is outputted in the base frame region outside of the window whereas the memory address (W) of the window frame computed in the second phase is outputted in the window. Since, in this mode, the one-memory cycle is made identical to the one display cycle, the data of the two independent frames can be variously synthesized and displayed although the speed of the memory and the number of parts for the system construction are identical to those of the case in which the CRT controller of the prior art type is used. In this mode, the time (as hatched in the drawing) other than the display period is used for the drawing process.

(b) Dual Access Non-Superposed Mode (FIG. 19(B))

In the mode in which two memory accesses are conducted during one display cycle, the first memory access is used for the display, and the second memory access is used for the drawing. In the first display cycle, the switching control is made such that the memory address (B) operated by the microprogram in the first phase is outputted 3 in the base frame region outside of the window whereas the memory address (W) operated in the second phase is outputted in the window. If this mode is used, the memory access time (as hatched in the drawing) for the drawing operation can be ensured even during the display period in addition to the time other than display period to effect the speed-up of the drawing process.

(c) Dual Access Superposed Mode (FIG. 19(C))

During one display cycle, two memory accesses are conducted so that the memory address (B) operated by microprogram of the first phase is outputted as the first memory access in the display region of the base frame whereas the memory address (W) computed by the microprogram of the second phase is outputted as the second memory access in the window. As a result, in the window, the two display memory accesses are conducted during one display cycle so that the superposed display can be made by synthesizing the data of the two independent frames read out by means of an external circuit. The second memory cycle (as hatched in the drawing) outside of the window can be used for the drawing cycle.

In order to display a stable image in a raster scan CRT, a frame memory access for attaining the display data has to be predominately conducted during the display period on the CRT. In a character display device handling code data, there is no substantia 1 trouble even if the access of the frame memory is limited to a fly-back period. In a graphic display device, however, there is a problem of retaining sufficient drawing cycles, because the data to be handled are increased.

As has been described hereinbefore, the present controller provides as an effective method the dual access mode by which the drawing cycle can be retained even during the display period. With reference to FIG. 19D, the relationship of the frame memory access in the two kinds, i.e., (a) the single access mode and (b) the dual access mode will be supplemented.

If the display is predominant in the single access mode, the drawing cycle is limited to the fly-back period. The drawing operation can be predominately conducted, which causes flickering in the case of many drawing cycles.

In the dual access mode, on the other hand, one half of the display period in addition to the fly-back period can be used as the drawing cycle. In this mode, it is necessary to read out twice the data (for the reading cycle for each display) as much as that of the single access mode. This necessity can be satisfied by doubling the memory cycle or the read bus width for the display.

It is empirically known that the ratio of the display period usually has to be about 70 to 80% of the total period of the drawing period and the display period. If, in this case, the display period is set at 75%, the drawing cycle in the single access mode necessarily becomes 25%, but the drawing cycle of 62.5% can be retained in the dual access mode.

The drawing capacity of the controller according to the present invention is substantially in direct proportion to the drawing cycle. The capacity can be improved to 2.5 times as large as that of the single access mode, if the read bus width is doubled, and to 5 times if the memory cycle is doubled.

(4) Arrangement of Memory Space and Flow Chart

Figure 20:
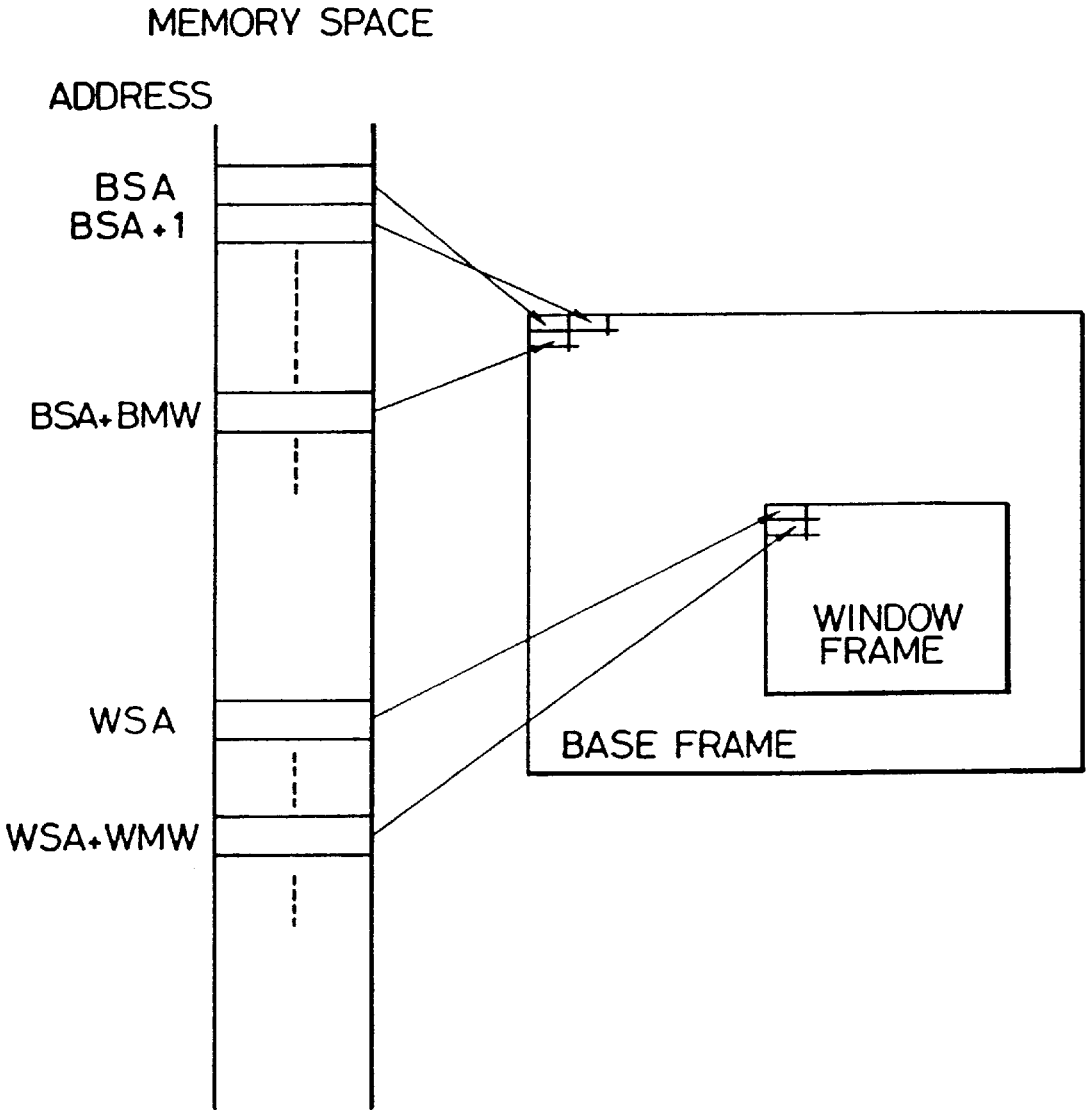
FIG. 20 explains the relationship of the address space of the memory and the display.
Figures 2A, 2B, 2C, 20:
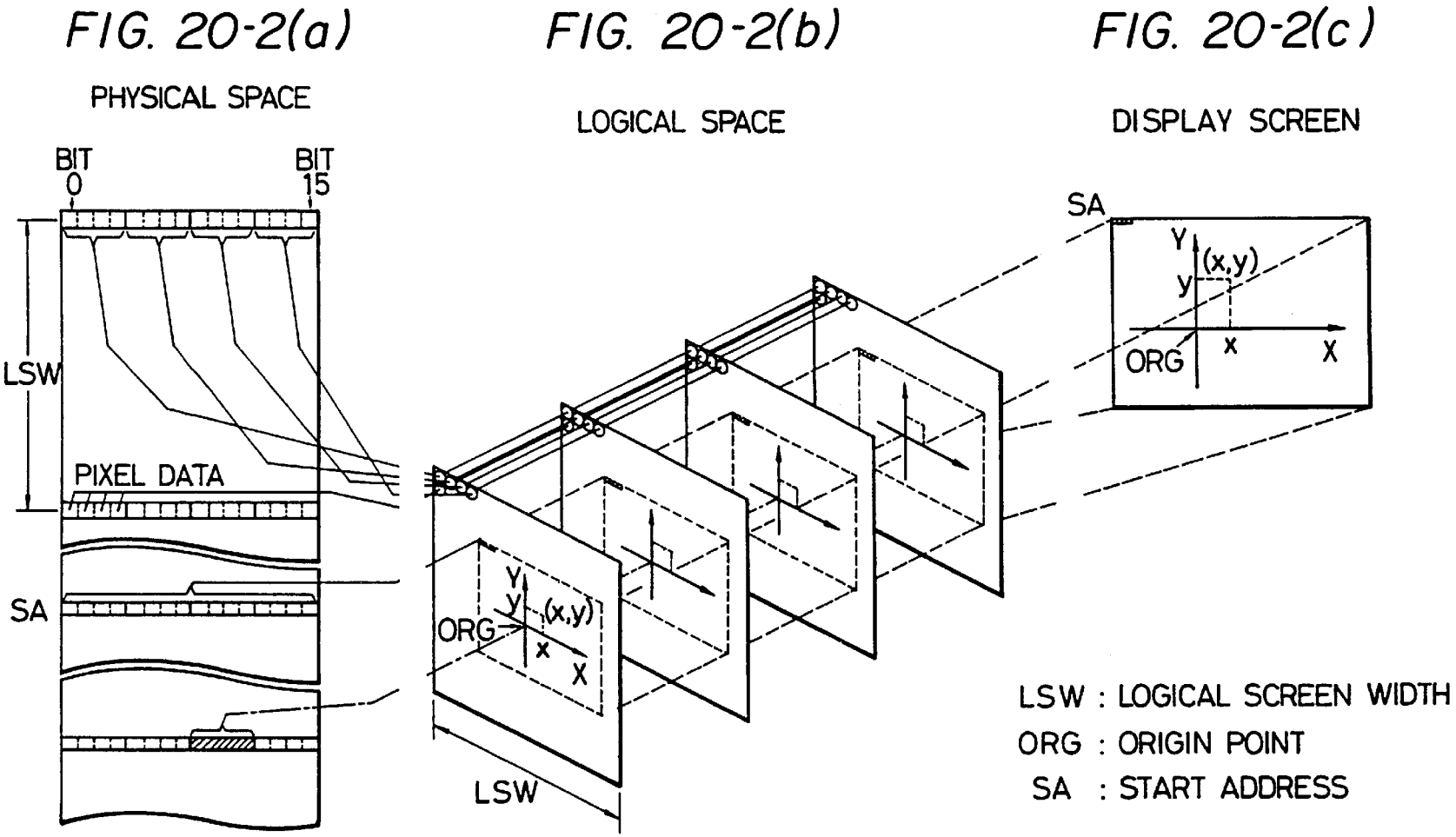

FIG. 20 shows the correspondence of the display frame and the memory space. As shown, the display data of the base frame and the window frame can be set an arbitrary size in the identical address space. As a result, the degree of freedom of the frame composition is enhanced together with the memory efficiency.

FIG. 20-2 shows the correspondence between the logical and physical spaces and the display frame. The same Figure corresponds to an example in the case of 4 bit/pixel (i.e., simultaneously 16 colors and 16 gradations) composed of four color planes. The physical memory has its one word composed of 16 bits and has continuous addresses assigned thereto. This physical space is displayed partially or wholly as an actual image on the display frame. The correspondence between the physical space and the logical space is administered by the correspondence between the width of the logical space (i.e., LSW: logical screen width) and origin point (i.e., ORG: origin point). Moreover, the correspondence between the logical space and the display frame is related by the display starting address (i.e., SA: start address).

Figure 21:
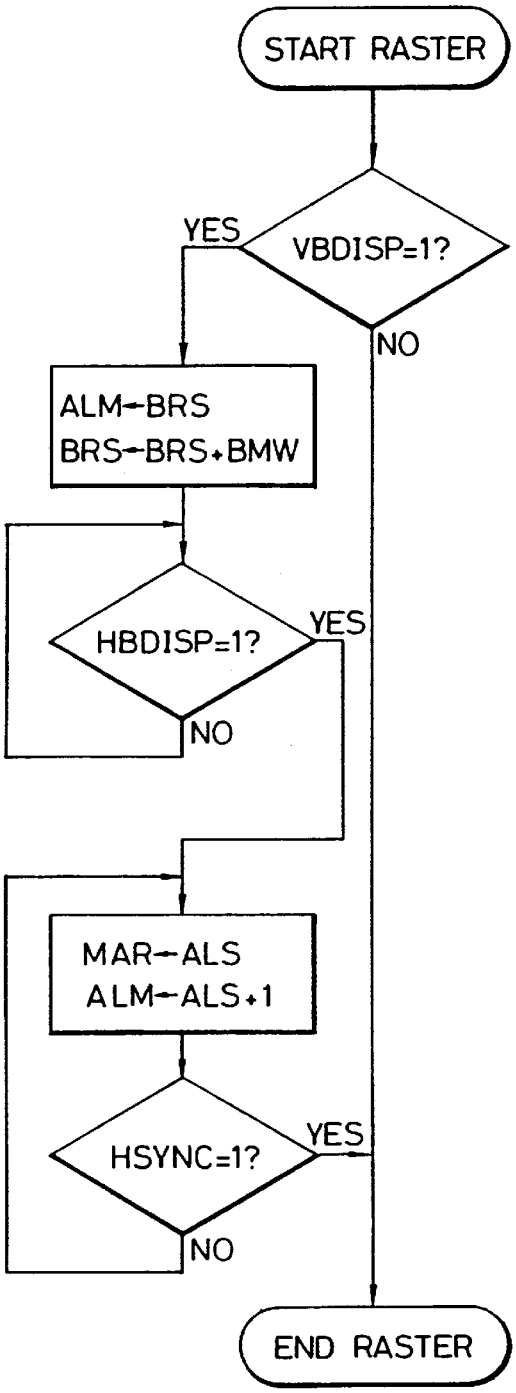
FIGS. 21 and 22 show examples of the process flows of the display processor.
Figure 22:
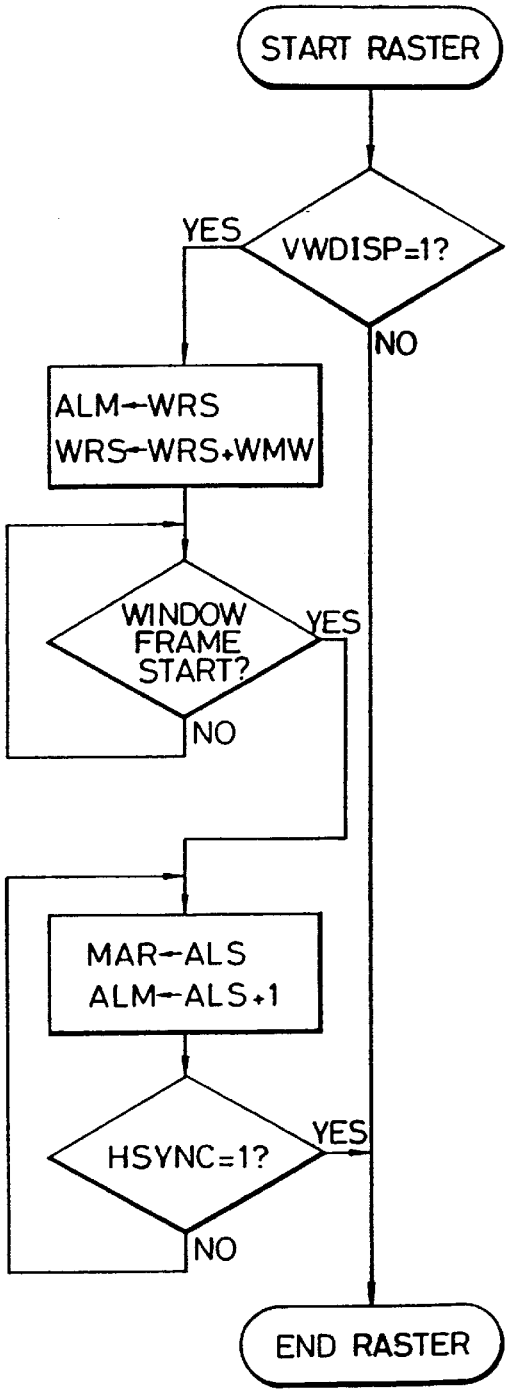

FIGS. 21 and 22 show examples of the processing of the microprograms, e.g., the first and second phases, respectively. The explanation will be made with reference to FIG. 21 as an example.

Immediately after the horizontal synchronizing signal, an examination is made whether the VBDISP signal is "1" or not. In the case of "0", the raster is ended with nothing being done. In the case of "1", the head address (BRS) in the raster of the base frame is sent to the registers (ALM and ALS) for controlling the display address at present, and the increment (BMW) of each raster is then added to the BRS and is stored as the head address of the subsequent raster in the BRS. Next, the cycle waits until the display starting point (HBDISP ="1") of the base frame. When this display starting point is reached, the ALS is transferred to the memory address register (MAR), in which the content of the ALS is counted up by +1. This process is repeated to sequentially output the memory addresses before the horizontal synchronizing signal is reached. Similar processes are conducted, too, in the case of FIG. 22.

In this example, the microprograms of the two independent systems are alternately processed so that the renewal and operation of the display addresses of the two systems can be efficiently conducted.

The display system using the display controller thus far described in the foregoing embodiment can produce a superposed display in which the memory efficiency of the refresh memories is enhanced, and can produce a superposed display having a high degree of freedom of the frame structure.

As has been described in detail hereinbefore according to the present invention, it is possible to provide a display controller which can conduct the superposed display with the use of the simple construction.

The effects of the controller of the present invention will be specifically explained in the following.

3. Summary of the Effects

The present controller can support both a drawing function to form a variety of drawings on the frame memory and a display function to read out the data from the frame memory and control the display on the CRT frame.

The drawing process is controlled by the command of one word (i.e., 16-bits) and the parameters of the subsequent several words. There is a command system which can be coordinately addressed by the use of X–Y coordinate values (i.e., the logical addresses), and the complex memory address (i.e., physical address) operations are processed inside of the ACRTC. The drawing commands include straight lines, circles, ellipses, painting-out and copying. On the other hand, the display function is controlled by the parameters which are written in the control register. The present controller has display functions of the frame division, window control, superposed display, scroll control, graphic cursor function, magnified display and so on.

3.1. High-Level Command Using X–Y Coordinates as Parameter When a graphics system is to be constructed, there is a problem whether the frame memory is to be subjected to a linear or X–Y addressing operation. The X–Y addressing operation is more direct but has its degree of freedom restricted in the hardware construction as in that type of unit the frame structure is limited to the power of 2 or a special memory is required. On the other hand, the linear addressing method can enjoy a higher degree of freedom in the hardware construction but has a defect in that the addressing operation is complicated. In the prior art, the linear addressing operation resorts to software processing to reduce the capacity.

The present controller has a complicated linear address operating mechanism built therein and has two kinds of address spaces, e.g., the logical space based on the X–Y coordinate system and the physical space addressed linearly. In other words, the access of the frame memory is linearly addressed, but the X–Y coordinates of excellent operability can be used for coordinately addressing the frame memory. Moreover, this addressing mechanism has such a structure as to correspond to colors or multiple gradations in which one pixel data are composed of plural bits. Thus, parameters dependent upon the hardware such as the frame structure or the color bit number can be absorbed by initializing the system and can be separated from the application software. As a result, it is possible to improve the productivity of the graphic software and to describe the highly transplantable software independent upon the hardware.

3.2. Processing Mode

In the controller of the present invention, the execution of the graphic drawing commands are made by the following three kinds of processing modes.

(1) Area Mode (Single Access Mode)

This mode has a function to check the drawing regions in accordance with the shift of the pointer when in the drawing operation and can be us ed for memory protection against an abnormal processing, clipping processing and the drawing detecting function as a result that the pointer is set as a drawable region or a drawing stopping region.

(2) Color Mode (Dual Access Non-Superposed Mode)

This is a mode concerning the development of the line kind data or patterns to the color register and can select such a processing as effects hatching by making use of the background drawing.

(3) Operation Mode (Dual Access Superposed Mode)

This mode assigns the logical operation and the conditional substitution concerning colors. It is possible to select the drawing mode according to the dominate order of the color data, the prohibition of drawing on a predetermined color, and the allowing mode of drawing only on a predetermined background color. The four cases as shown are based upon the assumption that the drawing is conducted in the order of yellow→red→blue on the black background and provide different expressions under the individual conditions.

3.3. Superposed Display

Four independent frames, i.e., three horizontally divided frames and one window frame can be synthesized and displayed. FIG. 10-3 shows an example of an application of the frame division. FIG. 10-4 shows an example of the frame division structure. A variety of frame structures can be made by controlling the parameters. The individual divided frames can establish logical spaces independently of one another. This frame division and the window function are realized by controlling the display addresses and the timings. Since it is unnecessary to change the content of the frame memories, the frame setting can be instantly changed by newly writing parameters in the control register. On the other hand, the window frame is also enabled to display the switching of another frame and the superposed display of another frame. This makes possible such an application (i.e., the superposed display) that the character frame and the drawing frame are displayed in a superposed manner in an arbitrary size and in an arbitrary position.

According to the controller of the present invention, moreover, scrolling operations in all directions can be effected for each divided frame by controlling the start address (SA) of that frame. The present controller also has a supporting function (i.e., the scrolling control) for realizing horizontal smooth scrolling (i.e., the smooth scrolling for each picture element unit).

3.4. Drawing Capacity

Figure 23:
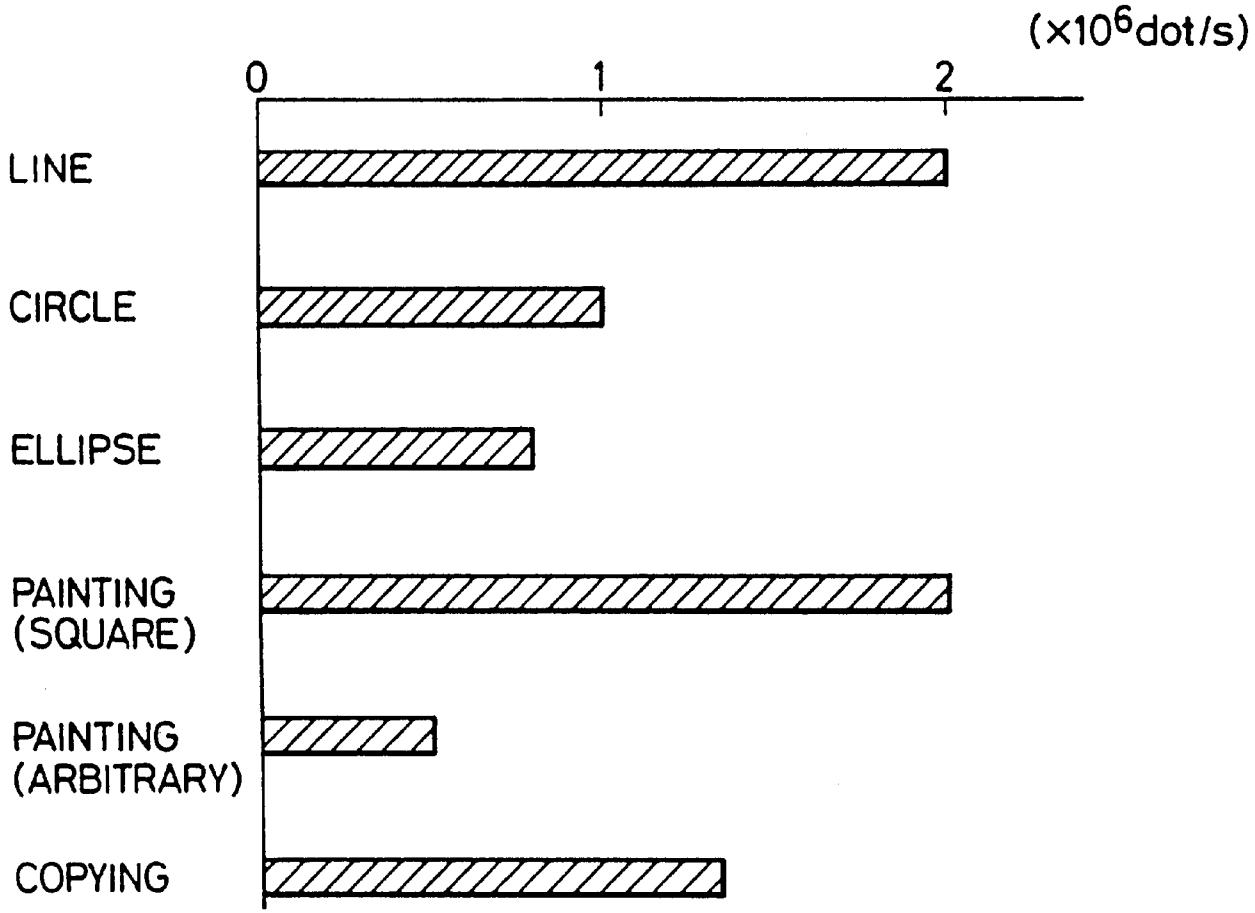
FIG. 23 shows the drawing capacity.

The present controller achieves drawing processing at a high speed. FIG. 23 is representative which shows the maximum capacity in the case when the drawing processing is conducted continuously at the clock frequency of 8 MHz. The one-dot drawing period is 0.5 -$\mu$s/dot for the straight lines, 2 $\mu$s/dot for painting out an arbitrary drawing, and 0.75 $\mu$s/dot for copying.

These drawing capacities are common for monochromatic and color operations by the special color processing mechanism and speeded up by one or two orders, as compared with those of the software processing of the prior art.

What is claimed is:

1. A display controller for inputting and outputting a signal to and from a computer to control a drawing operation used for inputting signals for storage in a refresh memory and to control a display operation used for reading out the signals stored in the refresh memory for display on a display device in response to clock signals from a clock, comprising:

a timing processing means responsive to the clock signals for generating display timing signals of a plurality of display frames;

a display processing means which stores display addresses in response to the display timing signals from the timing processor of a plurality of display frames, renews the display addresses of the plurality of display frames independently, and outputs the display addresses to the refresh memory in a time multiplexed manner; and a synthesizing means for synthesizing reading signals from the refresh memory in response to the plurality of display frames for a superposed display.

2. A display controller in accordance with claim 1, wherein said display processor comprises:

computing means for computing increments of display addresses whenever the display timing signals are generated from the timing processing means; and generating means for generating individual display addresses as a sum of the increments and the stored display starting addresses.

* * * * *